US010550836B2

(12) United States Patent
Shampine et al.

(10) Patent No.: US 10,550,836 B2
(45) Date of Patent: Feb. 4, 2020

(54) FREQUENCY SWEEPING TUBEWAVE SOURCES FOR LIQUID FILLED BOREHOLES

(75) Inventors: Rod Shampine, Houston, TX (US); Rajesh Luharuka, Katy, TX (US); Edward Leugemors, Needville, TX (US); Laurent Coquilleau, Houston, TX (US); John Daniels, Houston, TX (US)

(73) Assignee: Schlumberger Technology Corproation, Sugar Land, TX (US)

( * ) Notice: Subject to any disclaimer, the term of this patent is extended or adjusted under 35 U.S.C. 154(b) by 903 days.

(21) Appl. No.: 13/181,018

(22) Filed: Jul. 12, 2011

(65) Prior Publication Data

US 2012/0018150 A1 Jan. 26, 2012

Related U.S. Application Data

(60) Provisional application No. 61/367,561, filed on Jul. 26, 2010.

(51) Int. Cl.

| | |
|---|---|
| ***E21B 47/18*** | (2012.01) |
| ***F04B 47/02*** | (2006.01) |
| ***E21B 43/12*** | (2006.01) |
| ***F04B 23/06*** | (2006.01) |
| *E21B 47/00* | (2012.01) |

(Continued)

(52) U.S. Cl.

CPC ..... *F04B 47/02* (2013.01); *E21B 43/12* (2013.01); *E21B 47/18* (2013.01); *F04B 23/06* (2013.01); *E21B 47/00* (2013.01); *E21B 47/02208* (2013.01); *E21B 47/09* (2013.01)

(58) Field of Classification Search

CPC ..... F04B 47/02; F04B 23/06; E21B 47/00; E21B 47/09; E21B 47/091; E21B 47/101; E21B 47/18; E21B 47/182

USPC ..... 166/249, 254.1, 255.1, 250.14, 177.1; 367/83, 85; 181/119

See application file for complete search history.

(56) References Cited

U.S. PATENT DOCUMENTS

| | | | |
|---|---|---|---|
| 2,472,769 | A | 6/1949 | Goldstine |
| 3,254,524 | A | 6/1966 | Tannenberg |

(Continued)

FOREIGN PATENT DOCUMENTS

| | | | |
|---|---|---|---|
| GB | 2226634 | A | 7/1990 |
| GB | 2235540 | A | 3/1991 |

OTHER PUBLICATIONS

Merriam Webster—Orifice (Year: 2018).*

(Continued)

*Primary Examiner* — David Carroll
(74) *Attorney, Agent, or Firm* — Andrea E. Tran

(57) ABSTRACT

A system for generating variable frequency tube waves includes a high pressure multiplex pump having a number of plungers, with each plunger operatively coupled to a suction valve on a suction side and a discharge valve on a discharge side. The suction valve or the discharge valve of a first one of the plungers includes an opening, such that the modified plunger on a discharge stroke pushes fluid through the opening in the suction or discharge valve. The system includes a tubular fluidly coupling the high pressure multiplex pump to a wellbore, and a pressure sensor that receives tube waves generated by the high pressure multiplex pump and reflected from the wellbore.

7 Claims, 15 Drawing Sheets

(51) Int. Cl.
*E21B 47/022* (2012.01)
*E21B 47/09* (2012.01)

(56) References Cited

U.S. PATENT DOCUMENTS 3,289,406 A * 12/1966 Panhard ..... B04C 5/02 60/464
3,376,949 A 4/1968 Baker et al.
4,407,640 A * 10/1983 Namekata ..... F04B 49/24 417/296
4,523,901 A * 6/1985 Schippers et al. ..... 417/395
4,676,724 A * 6/1987 Birdwell ..... E21B 47/18 417/342
4,718,046 A 1/1988 Medlin
4,858,130 A 8/1989 Widrow
5,154,078 A 10/1992 Codazzi
5,163,029 A 11/1992 Bryant et al.
5,582,247 A * 12/1996 Brett et al. ..... 166/249
5,720,598 A * 2/1998 de Chizzelle ..... F04B 51/00 417/53
5,740,126 A 4/1998 Chin et al.
6,068,448 A * 5/2000 Muratsubaki ..... F04B 3/00 417/212
6,192,316 B1 2/2001 Hornby
6,401,814 B1 6/2002 Owens et al.
2007/0140869 A1* 6/2007 St. Michel et al. ..... 417/53
2009/0159272 A1* 6/2009 Auzerais et al. ..... 166/250.01
2010/0101787 A1* 4/2010 McCoy ..... E21B 43/121 166/250.03
2010/0183448 A1 7/2010 Leugemors et al.
2011/0267922 A1* 11/2011 Shampine ..... E21B 47/0005 367/25
2012/0152360 A1* 6/2012 Marica ..... F04B 17/048 137/1
2015/0233361 A1* 8/2015 Raghavan ..... F04B 11/005 417/62

OTHER PUBLICATIONS

A. Laaket, G.E.A. Meier (Max-Plank-Institut fur Stromungsforschlung, D-3400 Gottingen, FRG—A Generator for High Pressure Pulses in Liquids—Journal of Sound and Sound Vibration (1989) 131(2), 295-304 (Received Feb. 8, 1988, and in revised form Nov. 17, 1988).
International Search Report and Written Opinion issued in PCT/IB2011/053236 dated Mar. 27, 2012, 11 pages.
Examination Report issued in Great Britain Patent Appl. No. GB1301239.8 dated Aug. 18, 2017; 5 pages.
Search and Examination Report issued in Great Britain Patent Appl. No. GB1801755.8 dated Apr. 26, 2018; 6 pages.

* cited by examiner

FREQUENCY SWEEPING TUBEWAVE SOURCES FOR LIQUID FILLED BOREHOLES

RELATED APPLICATIONS

This application is related to, and claims the benefit of and priority to U.S. Provisional Application Ser. No. 61/367561, filed on Jul. 26, 2010, which is incorporated herein by reference in the entirety for all purposes.

BACKGROUND

Tube waves (or Stonely waves) are plane pressure waves that propagate through a tubular medium including annuli. These waves reflect from changes in the characteristic impedance of the medium. Examples of characteristic impedance changes include: a pipe diameter change, a closed end, a free surface, a gas bubble, a compressibility or density variation, a fluid change causing a change in the speed of sound, a pipe elastic modulus change, holes in a tubular with flow capacity, and so on. Combined with some knowledge of the wellbore geometry and/or the speed of the tube wave, the complex reflection patterns can be interpreted to yield useful information about the wellbore. Exemplary usages include locating the top of cement, identifying the setting of cement, locating which perforations in a well are passing fluid, confirming shifting of control valves, locating coiled tubing relative to downhole features, and so on.

Uniformly generated tube wave reflections, for example from tube waves generated by a constant frequency source, can be difficult to identify in noisy well pumping situations, for example during hydraulic fracturing or other treatments. Further, the penetration depth of a tube wave into a tube is inversely related to the frequency of the generated tube wave. Conversely, the resolution of the tube wave technique is directly related to the frequency of the generated tube wave. Accordingly, detection of various features in a wellbore may be amenable to various detection frequencies. Additionally, high energy tube waves are easier to detect than lower energy tube waves. State of the art impulsive pulse generators operate at less than about 3,500 kPa pulse amplitude and deliver pulse energy of less than about 1,000 joule.

SUMMARY

One embodiment is a unique system for generating variable frequency tube waves. Other embodiments include unique methods, systems, and apparatus to generate configurable frequency tube waves. Further embodiments, forms, objects, features, advantages, aspects, and benefits shall become apparent from the following description and drawings.

DESCRIPTION OF THE ILLUSTRATIVE EMBODIMENTS

Figure 1:
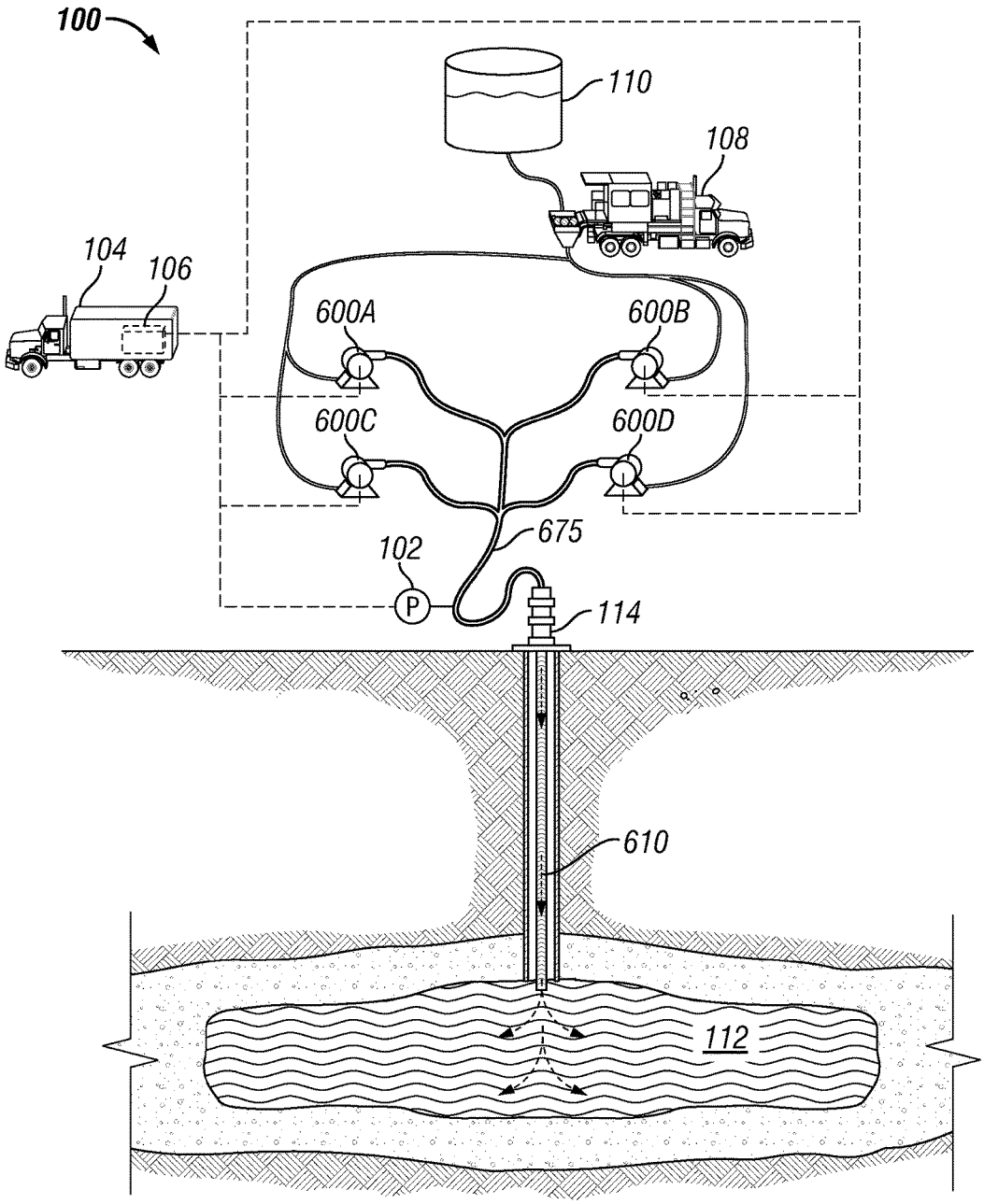
FIG. 1 is a schematic diagram of a system for generating variable frequency tube waves.

For the purposes of promoting an understanding of the principles of described embodiments herein, reference will now be made to the embodiments illustrated in the drawings and specific language will be used to describe the same. It will nevertheless be understood that no limitation of the scope of the contemplated embodiments is thereby intended, any alterations and further modifications in the illustrated embodiments, and any further applications of the principles of the described embodiments as illustrated therein as would normally occur to one skilled in the art to which the described embodiments relate are contemplated herein.

The development of a specific embodiment includes numerous implementation-specific decisions that must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. Wherever numerical descriptions are provided, each numerical value should be read once as modified by the term "about" (unless already expressly so modified), and then read again as not so modified unless otherwise indicated in context. It should also be understood that wherever a concentration range is listed or described as being useful, suitable, or the like, it is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

FIG. 1 is a schematic diagram of a system 100 for generating variable frequency tube waves. The exemplary system 100 includes a wellbore 114 fluidly coupled to a formation of interest 112. The system 100 includes a plurality of pumps 600A through 600D, fluidly coupled through a treatment line 675 to the wellbore 114. The system 100 includes a pressure sensor 102 operationally coupled to the treatment line 675 at a position available to receive reflected tube waves from the wellbore 114. The pressure sensor 102 may be a separately provided pressure sensor 102 as illustrated, or the pressure sensor 102 may be included with another device, for example as a pressure transducer on one of the pumps 600. Certain embodiments of the system 100 may include a device for generating variable frequency tube waves without a pressure sensor in the system 100. The system 100 is illustrated with four pumps 600, although any number of pumps 600 may be present in the system 100 including a single pump 600.

The pumps 600 are positive displacement pumps that provide high pressure fluid to the wellbore 114. An exemplary positive displacement pump 600 is a multiplex pump. A multiplex pump, as used herein, includes any pump having more than one positive displacement delivery chamber. An exemplary multiplex pump is a triplex pump, a three-plunger pump driven from a crankshaft coupling the plungers to a prime mover. Any other multiplex pump, including at least a quintiplex pump and a heptaplex pump are contemplated herein.

An exemplary plunger-based pump 600 includes a suction valve and a discharge valve. Under nominal operations, the suction valve opens on an intake movement of the plunger, drawing fluid from the suction side into the chamber. Upon the discharge movement of the plunger, the suction valve closes and the plunger pressurizes the fluid in the chamber. When the biasing force of the discharge valve is overcome, the discharge valve opens (e.g. unseats from the rest position) and the plunger forces the discharging fluid into the treatment line 675. These nominal operations of a plunger-based positive displacement pump 600 are well understood in the art and are not discussed further herein.

An exemplary system 100 includes a high pressure multiplex pump 600 having a number of plungers, each plunger operatively coupled to a suction valve on a suction side and a discharge valve on a discharge side. The suction valve of one of the plungers includes an opening therein, such that the plunger on a discharge stroke pushes fluid through the opening in the suction valve. Additionally or alternatively, an orifice 811 may be provided in a discharge valve of the pump. The pump 600 includes a single modified suction valve, but any subset of the suction valves and/or discharge valves may be modified, including modification of all suction valves (and/or discharge valves) except one. The system 100 includes a tubular (the treatment line 675) fluidly coupling the high pressure multiplex pump 600 to the wellbore 114, and a pressure sensor 102 that receives tube waves generated by the high pressure multiplex pump and reflected from the wellbore 114.

The opening in the suction valve allows flow from the chamber back into the suction side of the pump 600, preventing the discharge valve from opening (at least upon the initial movement of the plunger), and thereby providing a pressure fluctuation from the pump 600. Where the opening is provided in a discharge valve, the prevention of the opening of the discharge valve indicates that the discharge valve does not unseat from the rest position, and the only flow through the discharge valve at the initial movement of the pump is through the provided opening in the discharge valve. The opening in the suction valve (or discharge valve) provides for the plunger to perform work on the fluid exiting the chamber, allowing the work load on the prime mover to be leveled relative to a pump 600 having a plunger with the suction valve or discharge valve removed entirely. In certain embodiments, the opening in the suction valve is provided small enough (i.e. with high enough pressure drop at high rate operation) such that no torque reversals at the crankshaft occur when the pump 600 is operating in a highly loaded condition.

Figure 9:
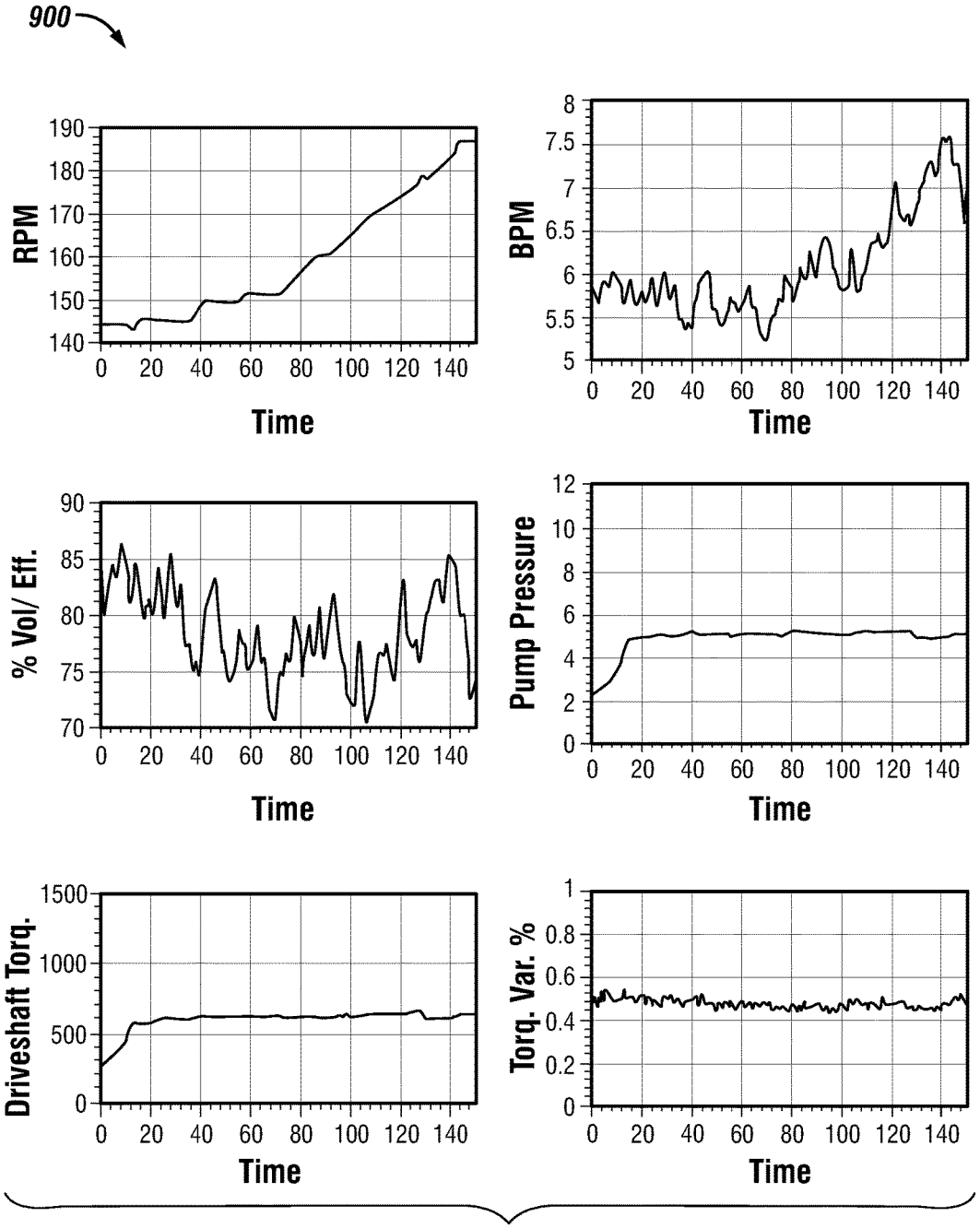
FIG. 9 depicts experimental data for a pump having a suction valve with an orifice therein.
Figure 10:
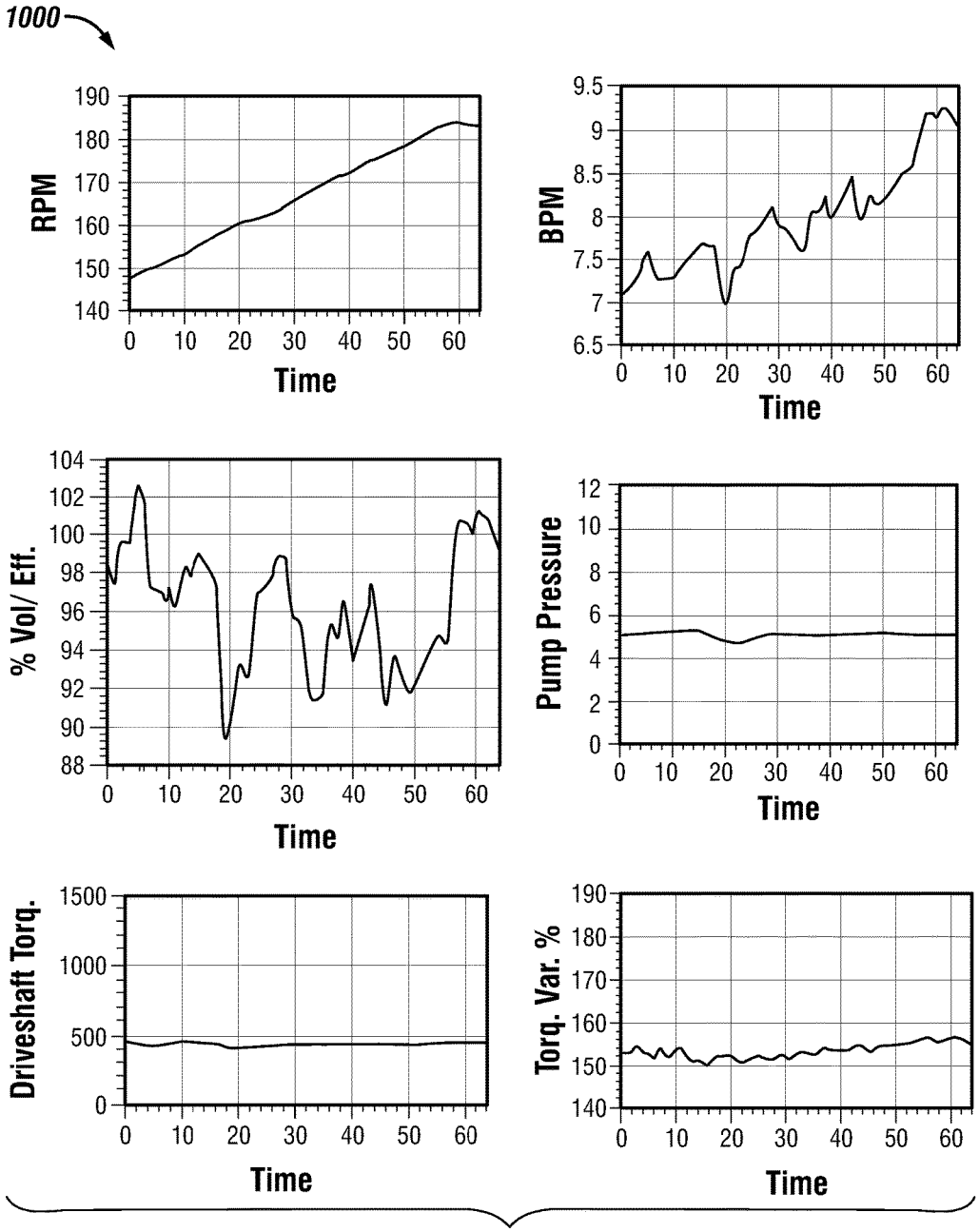
FIG. 10 depicts experimental data for a normally configured pump.
Figure 11:
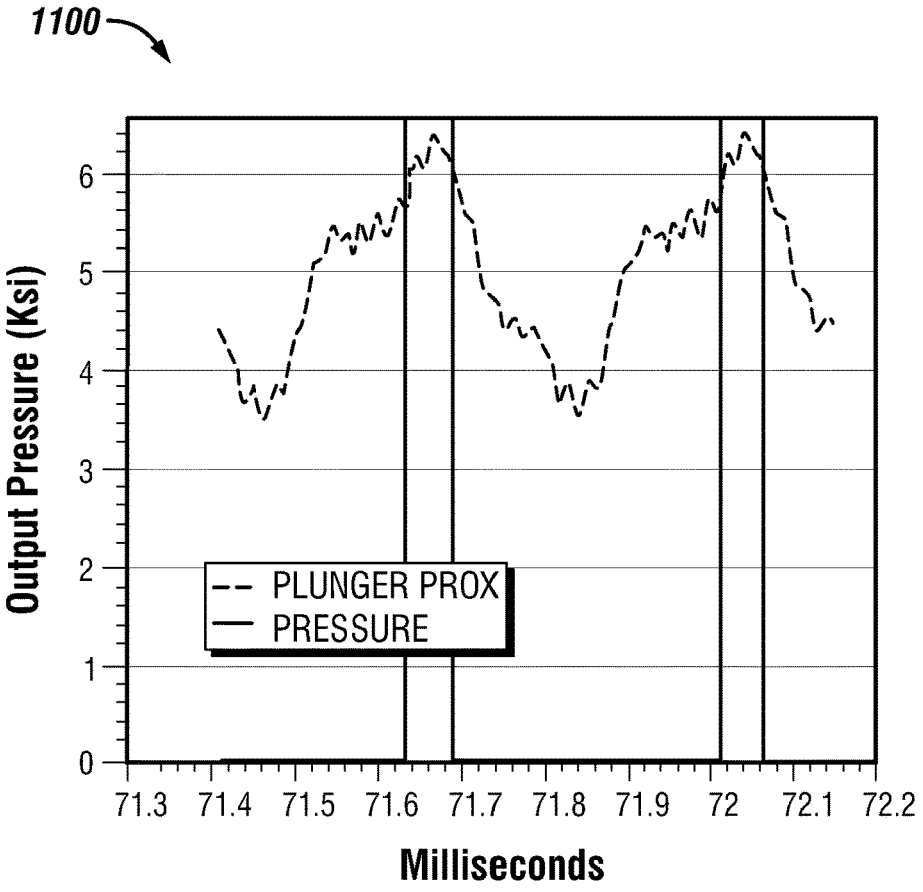
FIG. 11 depicts experimental data showing a pressure waveform for pump having a suction valve with an orifice therein.

Referencing FIG. 9, experimental data 900 for a pump having a suction valve with an orifice therein is depicted. The orifice in the suction valve for the data 900 of FIG. 9 was provided by drilling the valve. The data 900 illustrated demonstrates a maximum peak to peak torque variation of around 50%. Referencing FIG. 10, experimental data 1000 for an un-modified pump is depicted. The data 1000 in FIG. 10 demonstrates that maximum peak to peak torque variation is around 30% on a nominal pump. Accordingly, the torque variation in the modified pump is sufficiently close to the nominal pump to avoid detrimental wear or failure of the pump transmission. FIG. 11 depicts experimental data 1100 showing the pressure waveform for the modified pump plotted on a time-based scale.

Another exemplary system 100 further includes the high pressure multiplex pump 600 having three or more plungers, where two of the suction valves (and/or discharge valves) have openings therein. The opening(s) may be an orifice in the suction valve or discharge valve having any size. An exemplary orifice in the suction valve or discharge valve is sized between 0.2 cm and 1 cm diameter. An exemplary system 100 includes the opening being sized to provide a pumping pressure for the plunger at a scheduled treatment rate that is not greater than a specified discharge pressure, where the specified discharge pressure is selected as a pressure that does not yet open the discharge valve. Another exemplary system 100 includes the opening being sized such that the discharge valve opens only after the plunger has moved a predetermined distance at a scheduled treatment rate.

The illustrative system 100 further includes a fluid source 110, and a blender 108 or other device to supply low pressure fluid on the suction side of the pumps 600. The exemplary system 100 still further includes a control vehicle 104 having a controller 106. In certain embodiments, the controller 106 is structured to perform certain operations to generate variable frequency tube waves.

In certain embodiments, the controller 106 forms a portion of a processing subsystem including one or more computing devices having memory, processing, and communication hardware. The controller 106 may be a single device or a distributed device, and the functions of the controller 106 may be performed by hardware or software.

In certain embodiments, the controller includes one or more modules structured to functionally execute the operations of the controller 106. The description herein including modules emphasizes the structural independence of the aspects of the controller 106, and illustrates one grouping of operations and responsibilities of the controller 106. Other groupings that execute similar overall operations are understood within the scope of the present application. Modules may be implemented in hardware and/or software on computer readable medium, and modules may be distributed across various hardware or software components.

Certain operations described herein include operations to interpret one or more parameters. Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a runtime parameter by any means known in the art, and/or by receiving a value by which the interpreted parameter can be calculated, and/or by referencing a default value that is interpreted to be the parameter value.

A first exemplary controller includes modules structured to functionally execute the operations of the controller 106. The exemplary controller includes a tube wave determination module and a pump control module. The tube wave determination module interprets a tube wave modulation schedule, and the pump control module provides a pump rate command in response to the tube wave modulation schedule. The high pressure multiplex pump is responsive to the pump rate command. More detailed operations of the exemplary controller are provided in the description referencing FIG. 2.

An exemplary system 100 includes a first set of pumps (e.g. pumps 600A and 600B), and a second set of pumps (e.g. pumps 600C and 600D). Each set of pumps may include, in certain embodiments, any other number of pumps including a single pump. Each set of pumps need not include the same number of pumps. The exemplary system 100 includes a second exemplary controller 106 having a tube wave determination module that interprets a first rate relationship for the first set of pumps and a second rate relationship for the second set of pumps. The controller 106 further includes a pumping requirements module that interprets a total pumping rate and/or a pump schedule, and a pump control module that provides pump rate commands to the first set of pumps and the second set of pumps in response to the first rate relationship, the second rate relationship, and the one of the pumping rate and the pump schedule.

In certain embodiments, the pumping requirements module determines a first pumping contribution from the first set of pumps and a second pumping contribution from the second set of pumps, such that a total amount of fluid delivered from the pumps matches the pumping rate or the relevant portion of the pump schedule. In certain further embodiments, the controller 106 includes a tube wave feedback module that determines pumping rates actually achieved from each pump, and identifies aspects of reflected tube waves in response to the pumping rates actually achieved. In certain embodiments, the first rate relationship and the second rate relationship are enforced, and/or the pumps are controlled to rates matching the first rate relationship and the second rate relationship over a period of time. More detailed operations of the second exemplary controller 106 are provided in the description referencing FIG. 2.

Figure 2:
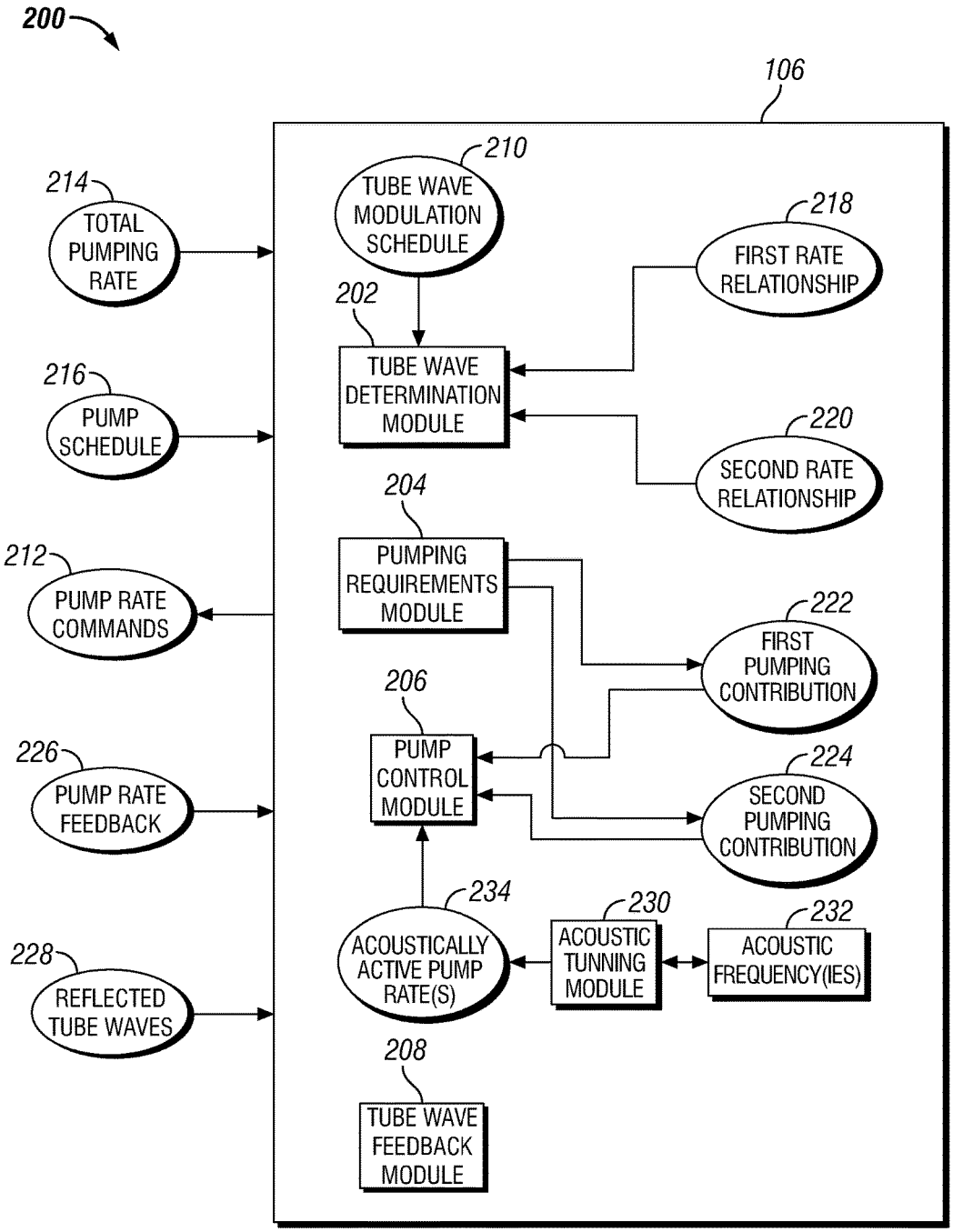
FIG. 2 is a schematic diagram of a controller performing certain operations for generating variable frequency tube waves.

FIG. 2 is a schematic diagram of a controller 106 performing certain operations for generating variable frequency tube waves.

In certain embodiments, the controller 106 includes a tube wave determination module 202 and a pump control module 206. The tube wave determination module 202 interprets a tube wave modulation schedule 210. The tube wave modulation schedule 210 allows the controller 106 to provide a configurable tube wave frequency modulation scheme. The frequency ranges provided by the tube wave modulation schedule 210 may be selected according to the wellbore depth, resolution required to detect the desired features in the wellbore, or for any other reason understood by one of skill in the art having the benefit of the disclosures herein. The frequency ranges of the tube wave modulation schedule 210 may include one or more swept ranges, a plurality of discrete frequency values, and/or any other set of selected frequency ranges.

The controller 106 further includes the pump control module 206 providing a pump rate command 212 in response to the tube wave modulation schedule 210. The pump rate command 212 may be determined by the pump rate of the pump providing the tube waves that achieves the selected frequencies. The pump rate of the pump to achieve the selected frequencies depends upon the mechanism of the pump providing the tube wave, and is readily calculated by one of skill in the art for a given embodiment having information about the pump modification that is normally available or readily determined. Certain pump modifications may generate tube waves having a frequency that is proportional to the frequency of the pump crankshaft. The high pressure multiplex pump is responsive to the pump rate command 212.

In certain embodiments, the controller 106 is provided in a system 100 having a first set of one or more pumps and a second set of one or more pumps. The controller 106 includes the tube wave determination module 202 that interprets a first rate relationship 218 for the first set of pumps and a second rate relationship 220 for the second set of pumps. Two pumps operating at a similar pumping rate generate a beat frequency therebetween, where the beat frequency is the difference between the two pumps. The first rate relationship 218 provides for a rate relationship between the pumps on the first set of pumps—for example a linearly, logarithmically, and/or geometrically increasing pump rate. Similarly, the second rate relationship 220 provides for a rate relationship between the pumps on the second set of pumps.

The controller 106 further includes a pumping requirements module 204 that interprets a total pumping rate 214 and/or a pump schedule 216. The total pumping rate 214 is a simple pumping rate target for the pumps, where the sum of the first and second set of pumps combine to provide the total pumping rate 214. The total pumping rate 214 may be the pumping rate of a treatment (e.g. 30 bpm for a particular hydraulic fracture treatment), or the total pumping rate 214 may be a portion of a pumping rate of a treatment, for example where more pumps are in the system beyond the pumps in the first and second set of pumps. The total pumping rate 214 may be a single value or may be updated during runtime operations of the controller 106. The pump schedule 216 includes a staged or time-based set of total pumping rates that the controller 106 follows during a treatment, and may further be updated during runtime operations of the controller 106.

The exemplary controller 106 further includes a pump control module 206 that provides pump rate commands 212 to the first set of pumps and the second set of pumps in response to the first rate relationship 218, the second rate relationship 220, and the pumping rate 214 and/or the pump schedule 216. For example, where the first set of pumps includes three pumps, where first rate relationship 218 includes rates of X with 0.3 bpm linear increases, and the first set of pumps are expected to provide 15 bpm of fluid delivery, the pump control module 206 provides the pump rate commands 212 at 4.7 bpm, 5.0 bpm, and 5.3 bpm for the first set of pumps.

In certain embodiments, the controller 106 includes a pumping requirements module 204 that determines a first pumping contribution 222 from the first set of pumps and a second pumping contribution 224 from the second set of pumps, such that a total amount of fluid delivered from the pumps matches the pumping rate 214 or the relevant portion of the pump schedule 216. In one example, the first set of pumps and the second set of pumps each include three pumps. The total pumping rate 214 is 30 bpm. The first rate relationship 218 is a 10% increasing rate, and the second rate relationship is a 30% increasing rate. The pumping requirements module 204 provides the first pumping contribution 222 as 12 bpm of the 30 bpm, and the second pumping contribution 224 as 18 bpm of the 30 bpm. Accordingly, the pump control module 206 provides the pump rate commands 212 as 3.6, 4.0, and 4.4 bpm for the first set of pumps, and 4.5, 5.9, and 7.6 bpm for the second set of pumps. In certain embodiments, the pumping requirements module 204 sweeps the pump rates. In the example, the pumping requirements module 204 sweeps the first pumping contribution 222 to 18 bpm and the second pumping contribution 224 to 12 bpm, in a manner such that the total pumping rate 214 is achieved. In the example, the pump rate commands 212 for the 18 bpm first pumping contribution 222 are 5.4, 6.0, and 6.6 bpm for the first set of pumps and 3.0, 3.9, and 5.1 bpm for the second set of pumps. The rate of change of the pumping contributions 222, 224 are provided according to the selected tube wave frequency sweeping, for example cycling between a maximum and minimum rate at 1/20 Hz. The cycling frequency may be any value known in the art.

In certain further embodiments, the controller 106 includes a tube wave feedback module 208 that determines pumping rates actually achieved from each pump. In the example of FIG. 2, the tube wave feedback module 208 receives pump rate feedback 226, which may be provided in one example by electronic communication from a pump controller. The tube wave feedback module 208 identifies aspects of reflected tube waves 228 in response to the pumping rates actually achieved. An exemplary tube wave feedback module 208 utilizes the pump rate feedback 226 to identify the reflected tube waves 228 returning from the wellbore, which may not be identical to the planned tube wave modulation schedule 210 due to actual achieved pumping rates varying from the pump rate commands 212.

In certain embodiments, the first rate relationship 218 and the second rate relationship 220 are enforced by the pump rate commands 212. Additionally or alternatively, the pump rate commands 212 are provided to control the pumps to the first rate relationship 218 and the second rate relationship 220 in a controllable fashion, for example over a period of time.

An exemplary embodiment of a controller 106 includes an acoustic tuning module 230 that interprets one or more acoustic frequencies 232 of a component operationally coupled to the positive displacement pump. The component may be any component which is capable of exhibiting a resonant response from the pressure pulses of the operating pump. An exemplary component includes a tubular. In certain embodiments, one or more pumps may be positioned close to the wellhead at a pumping location to increase the acoustic response of the tubular. In certain embodiments, the acoustic tuning module 230 interprets the acoustic frequencies 232 according to predetermined values stored on the controller 106, according to values input by an operator according to a well test or calculations prior to performing a treatment operation, and/or the acoustic tuning module 230 monitors pressure data in real time during a treatment to determine when an acoustic frequency 232 is being induced.

Figure 22:
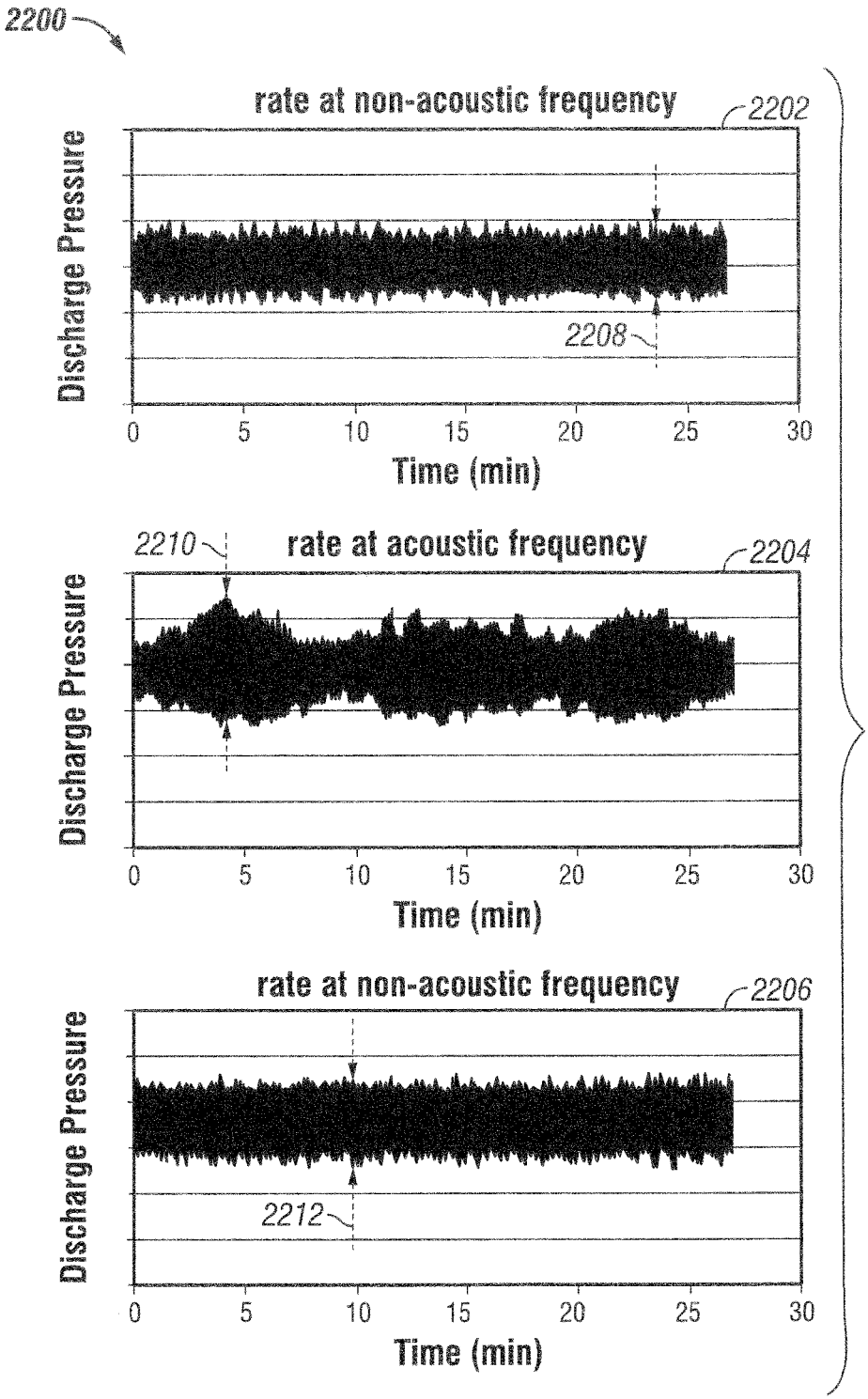
FIG. 22 depicts illustrative data representing an acoustic response of a component.

Referencing FIG. 22, illustrative data 2200 shows a standard discharge pressure fluctuation occurring at a pump rate lower than an acoustic frequency (data 2202) and a pump rate higher than the acoustic frequency (data 2206). A resonant acoustic response is observed at the acoustically active pump rate (data 2204). The peak to peak pressure fluctuations for the pump rates away from the acoustically active pump rate in the exemplary data 2202, 2206 are observed to be about two-thirds of the magnitude of the peak to peak pressure fluctuations in the exemplary data 2204 corresponding to the acoustically active pump rate. The acoustically active pump rate may be a rate within a range of pump rates. The acoustic peak to peak pressure fluctuations may be of significantly higher amplitudes than for the data illustrated in FIG. 22, including double the non-acoustic peak to peak pressure amplitudes or even higher. The illustrated responses are exemplary and non-limiting. The actual response depends upon the mass of the system being resonated, the acoustic characteristics of the tubular or other resonating component, the sampling rate of the pressure sensor detecting the acoustic response, and other parameters understood in the art.

The acoustic tuning module 230 determines one or more acoustically active pump rate(s) 234. In certain embodiments, the acoustic tuning module 230 modulates the pump rate(s) through a number of rate values until one or more acoustically active pump rate(s) 234 are determined. In certain embodiments, the acoustic tuning module 230 determines an acoustically active pump rate 234 directly according to the acoustic frequency 232, and/or the acoustic tuning module 230 determines the acoustically active pump rate 234 in conjunction with interpreting the acoustic frequency 232. For example, the acoustic tuning module 230 modulates the pump rate to induce a resonant response, and determines the acoustically active pump rate 234 as the rate inducing the acoustic response. Exemplary and non-limiting operations for the controller 106 to modulate the variable frequency tubewave include a pump control module 206 providing a pump rate command 212 that moves into and out of the acoustically active pump rate 234, and/or a pump rate command 212 that moves between more than one acoustically active pump rate 234. The modulating the variable frequency tubewave may be performed at a scheduled rate to provide a controlled signaling sequence.

Figure 3:
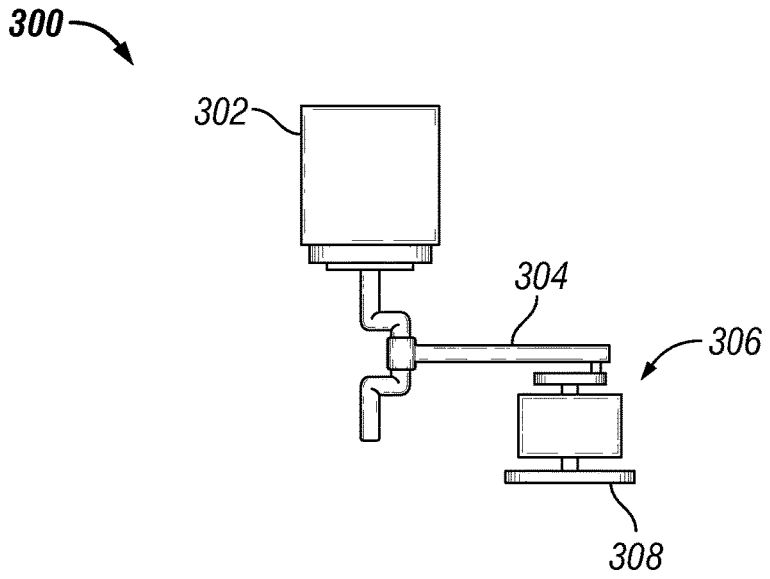
FIG. 3 is an illustration of a flywheel coupled to a plunger for a pump.

Referencing FIG. 3, an illustration 300 is provided of a flywheel 308 mechanically coupled to a plunger pump 304. The flywheel 308 transfers energy to and from the plunger pump 304, dampening the load transfer on a prime mover 302. The use of a load dampening device at least partially separates the energy required to carry the pressure load (e.g. the work to push the plunger pump 304 against the treatment pressure) from the energy required to provide the signal or tubewave pressure pulse. The use of a load dampening device at least partially load balances the static force on the plunger pump 304.

Certain embodiments include modifications to a plunger pump 304 that cause variations in the static rod load of the prime mover, and/or variations in the work required from the prime mover 302 during the discharge portion of the plunger pump 304 movement relative to the work required from the prime mover 302 during the discharge portion of other plungers (not shown) on the pump. Exemplary and non-limiting modifications that cause discharge work fluctuations of the prime mover 302 include removal or modification of the suction valve, designed valve float of the discharge and/or suction valve, removal of a discharge valve, and fluid pressure coupling of the treatment fluid end of the plunger pump 304 to an opposing end of the plunger pump 304. The large difference in static rod load can cause vibration, clunking, and/or damage to the power train of the prime mover 302.

In certain embodiments, the flywheel 308 is mechanically coupled to the plunger pump 304 through a mechanical ratio device 306, including a transmission, a continuously variable transmission, or other device known in the art. The use of the ratio device 306 allows for the flywheel 308 to operate in a desired speed range while still interfacing with the plunger pump 304. In certain embodiments, the gear ratios of the ratio device 306 are selected, during at least portions of the operating space of the pump, such that the flywheel 308 is spinning faster than a unitary ratio connection would provide. Further, by varying the ratio while pumping, kinetic energy may be cycled into and out of the flywheel, thus modulating the torque delivered by the prime mover.

Figure 4:
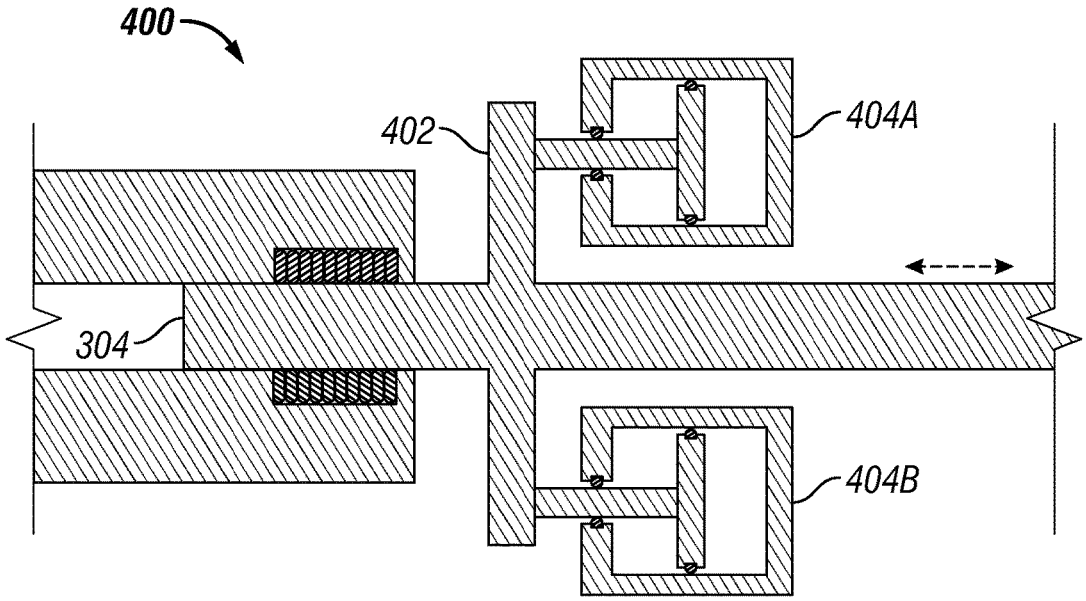
FIG. 4 is an illustration of pneumatic cylinders coupled to a plunger for a pump.

Referencing FIG. 4, an illustration 400 is provided of pneumatic cylinders 404A, 404B mechanically coupled to the plunger pump 304. The pneumatic cylinders 404A, 404B provide similar dampening of the prime mover work output to the flywheel illustrated in FIG. 3. The embodiment of FIG. 4 shows two pneumatic cylinders 404A, 404B, but a given embodiment may have any number of pneumatic cylinders 404 including a single cylinder or multiple cylinders. The pneumatic cylinders 404 may be pre-charged, controllably charged during pump operations, and or vented to provide the desired dampening characteristics from the cylinders 404. In certain embodiments, the pneumatic cylinders 404A and 404B are provided coupled to a plunger pump 304 having a discharge valve removed. The configuration with the pneumatic cylinders 404 cause the volume of fluid equal to the plunger discplacement volume to move in and out of the treating fluid system, providing the movement of the plunger pump without net pumping work. The signal energy of the system is moved into and out of the cylinder 404, balancing the pressure force acting on the plunger and reducing the force needed to reciprocate the plunger.

Figure 5:
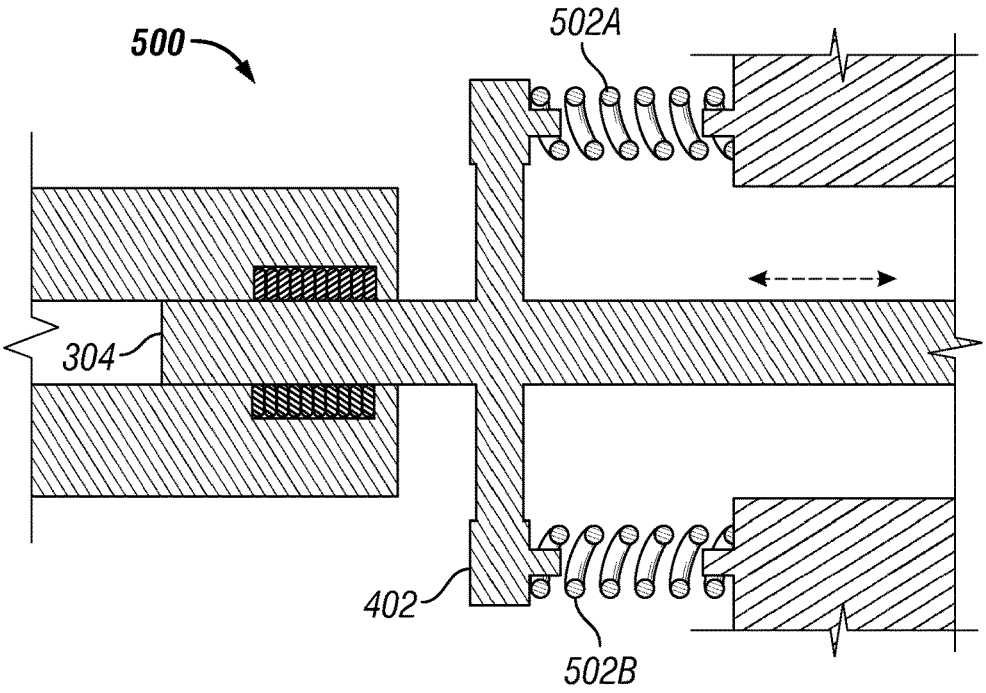
FIG. 5 is an illustration of springs coupled to a plunger for a pump.

Referencing FIG. 5, an illustration 500 is provided of springs 502A, 502B mechanically coupled to the plunger pump 304. FIG. 5 is an illustration of springs coupled to a plunger for a pump. The springs 502A, 502B provide similar dampening or pressure load balancing of the prime mover work output to the flywheel illustrated in FIG. 3 and the cylinders illustrated in FIG. 4. The embodiment of FIG. 5 shows two springs 502A, 502B, but a given embodiment may have any number of springs 502 including a single spring or multiple springs. The springs 502 may provide controllable balancing by any mechanism understood in the art. Exemplary spring balancing control operations include, without limitation, providing springs with selected spring constants before a treatment operation, and/or extending or retracting the springs during the treatment operation.

Figure 6:
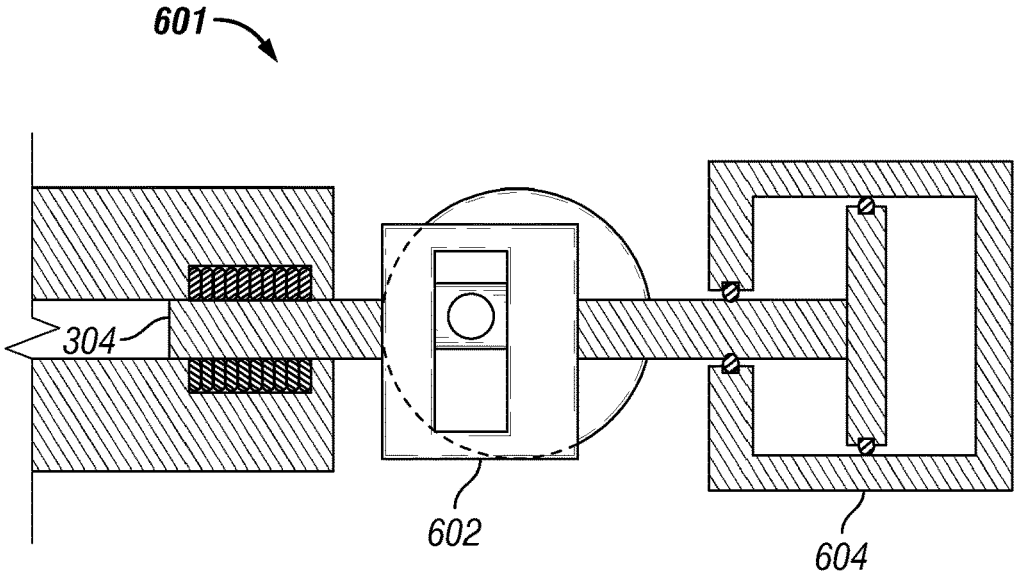
FIG. 6 is an illustration of a scotch yoke coupling a plunger for a pump to a crankshaft of the pump.

Referencing FIG. 6, an apparatus 601 includes a scotch yoke 602 coupling a plunger pump 304 to a crankshaft of the pump. The scotch yoke 602 couples the crankshaft to the plunger pump 304 to provide for conversion of the rotational motion of the crankshaft to the reciprocating linear motion of the plunger pump 304. In certain embodiments, the scotch yoke 602 provides a mechanical coupling location between a pressure load balancing device and the plunger pump 304. The illustration of FIG. 6 shows a pneumatic load balancer 604 mechanically coupled to the scotch yoke 602, although any load balancing device understood in the art may be provided.

Figure 7:
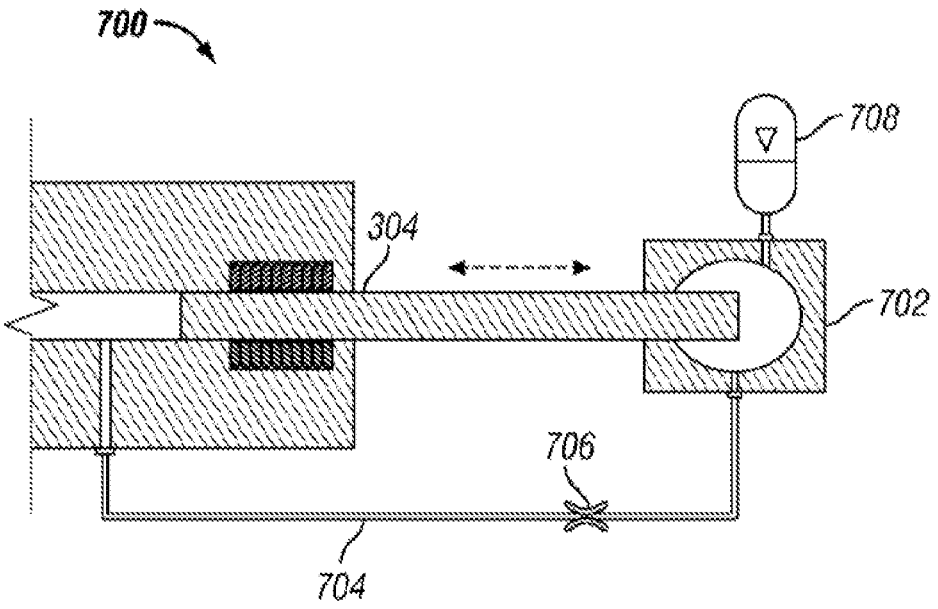
FIG. 7 is an illustration of a treatment fluid in pressure communication with an opposing end of a plunger for a pump.

Referencing FIG. 7, an apparatus 700 includes a self adjusting rod load compensator. The self adjusting rod load compensator includes a fluid pressure connection 704 coupling the treatment fluid pressure with a chamber 702 is an illustration of a treatment fluid in pressure communication with an opposing end of a plunger for a pump. The apparatus 700 of FIG. 7 includes an accumulator 708 fluidly coupled to the chamber 702. The fluid pressure connection 704 further includes an orifice 706 (which may be controllable). The orifice 706 and accumulator 708 may include pressure capacitance and impedance values that filter the chamber 702 pressure such that the chamber 702 pressure approximates the average pressure in the treating fluid. The orifice 706 and accumulator 708 may be tuned according to the expected characteristics of the treatment, and/or the orifice 706 and accumulator 708 may be adjusted during runtime operations of the pump.

Figure 8:
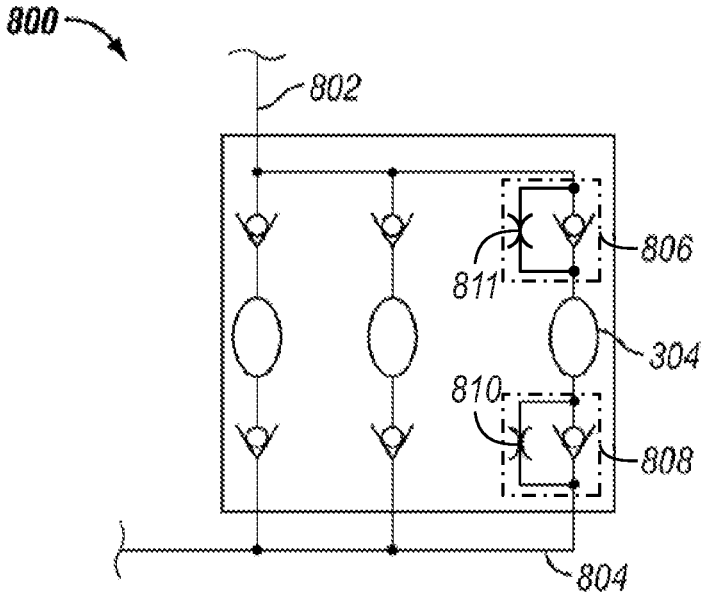
FIG. 8 is an illustration of a suction valve having an orifice therein.

Referencing FIG. 8, a schematic illustration 800 of a pump having a modified suction valve 808 is depicted. The pump includes a discharge 802 and a suction side 804. The plunger pump 304 accepts fluid from the suction valve 808 and provides fluid through the discharge valve 806, unless the pressure in the pump chamber does not exceed the discharge valve 806 opening pressure. The suction valve 808 in FIG. 8 includes an orifice 810 therein, which may be drilled, punched, or otherwise manufactured into the valve 808. Any type of bypass or partial bypass of the suction valve 808 is contemplated herein, including a bypass channel or other mechanism.

Figure 12:
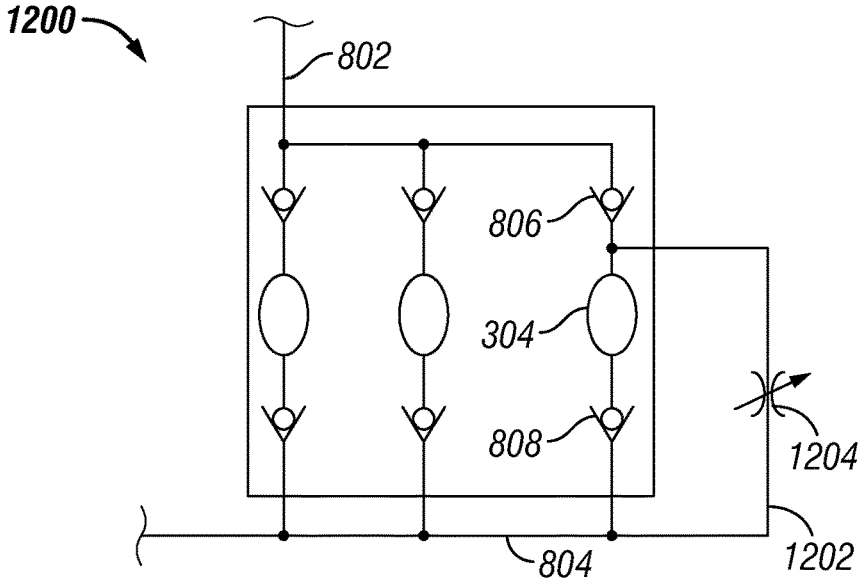
FIG. 12 is an illustration of a pump having a controllable fluid pressure connection between a suction side and a discharge side of a plunger for a pump.

Referencing FIG. 12, a schematic illustration 1200 of a pump includes a controllable fluid pressure connection 1202 between a suction side and a discharge side of a plunger pump 304 for the pump. The controllable fluid pressure connection 1202 includes a controllable orifice 1204. When the orifice 1204 is at least partially opened, the pump becomes a tube wave source generator. When the orifice 1204 is closed, the pump is a normally operating pump. The orifice 1204 may be modulated to provide the desired tube wave frequency, which can be a higher or a lower frequency than the reciprocating frequency of the plunger pump 304. In certain embodiments, additional orifices 1204 may be provided to allow for more complex pressure wave characteristics. Further, a controllable fluid pressure connection 1202 may be coupled to one or more additional plungers of the pump.

Figure 13:
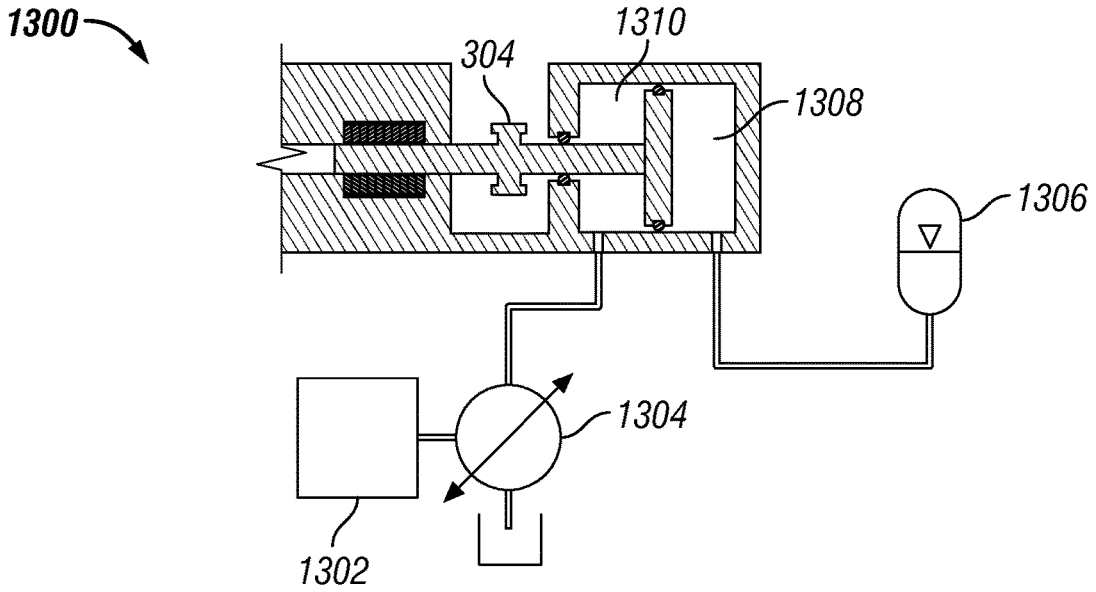
FIG. 13 is an illustration of a hydraulic cylinder configured to provide linear motion of a plunger for a pump.

Referencing FIG. 13, a schematic illustration 1300 of a plunger pump 304 is shown, with a hydraulic cylinder 1304 operationally coupled to the plunger pump 304 to provide linear motion to the plunger pump 304 by pressurizing or depressurizing a chamber 1310 on a front side of the plunger. An accumulator 1306 is provided in communication with a chamber 1308 on the back side of the plunger pump 304 to accept the rod load. The accumulator 1306 may be pre-charged, or controllably charged during operations of the pump. The embodiment of FIG. 13 is shown with no discharge valve present. A prime mover 1302 is also depicted.

Figure 14:
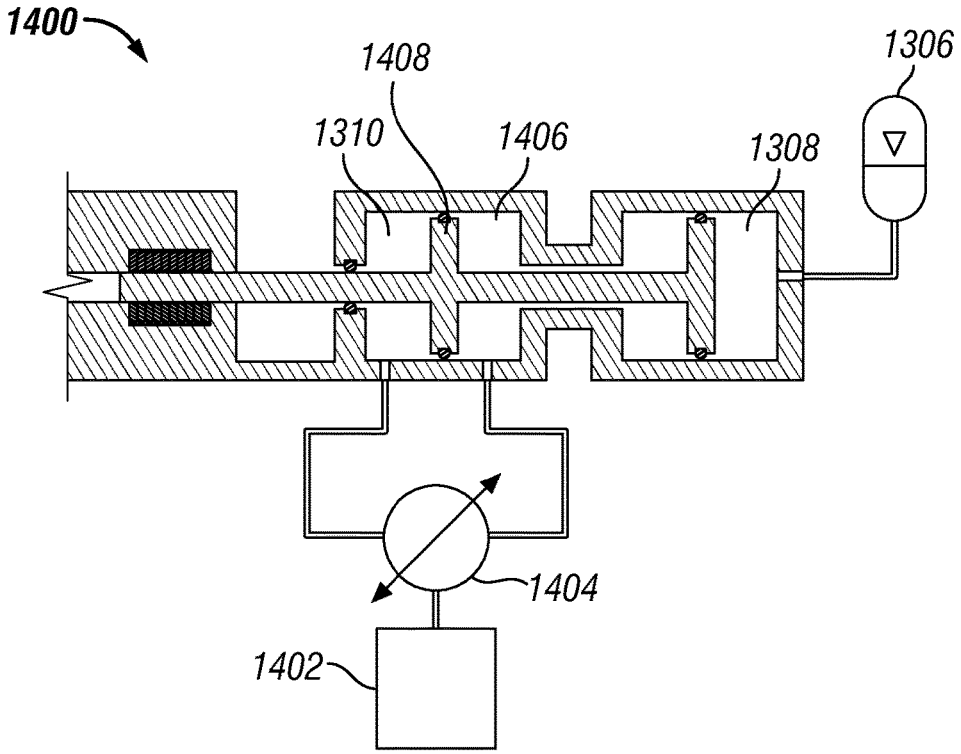
FIG. 14 is an illustration of a hydraulic cylinder configured to provide bi-directional motion of a plunger for a pump.

Referencing FIG. 14, a schematic illustration 1400 of a plunger pump 304 is shown, with a hydraulic cylinder 1404 selectively coupled to either side of a plunger feature 1408. The hydraulic cylinder 1404 in the FIG. 14 is a four quadrant bi-directional variable displacement pump that can drive the plunger pump 304 in either direction under load. The hydraulic cylinder 1404 is selectively in communication with a chamber 1310 on the front side of the feature 1408 or with a chamber 1406 on the back side of the feature 1408. An accumulator 1306 is provided in communication with a chamber 1308 on the back side of the plunger pump 304 to accept the rod load. The accumulator 1306 may be pre-charged, or controllably charged during operations of the pump. A prime mover 1402 is also depicted. Any of the embodiments described with reference to FIGS. 13 and 14 may additionally or alternatively include the plunger pump 304 coupled to another dampening device, including without limitation a flywheel.

In certain embodiments, a system includes a modification to one or more discharge valves or suction valves of a positive displacement pump. The modification provides one or more valves with a valve float period during the operations. A modification to cause valve float may be any modification understood in the art, including at least providing a valve with a reduced spring force, providing a valve with an increased mass, and/or providing the specific plunger pump chamber with a fluid having an increased fluid viscosity.

Figure 15:
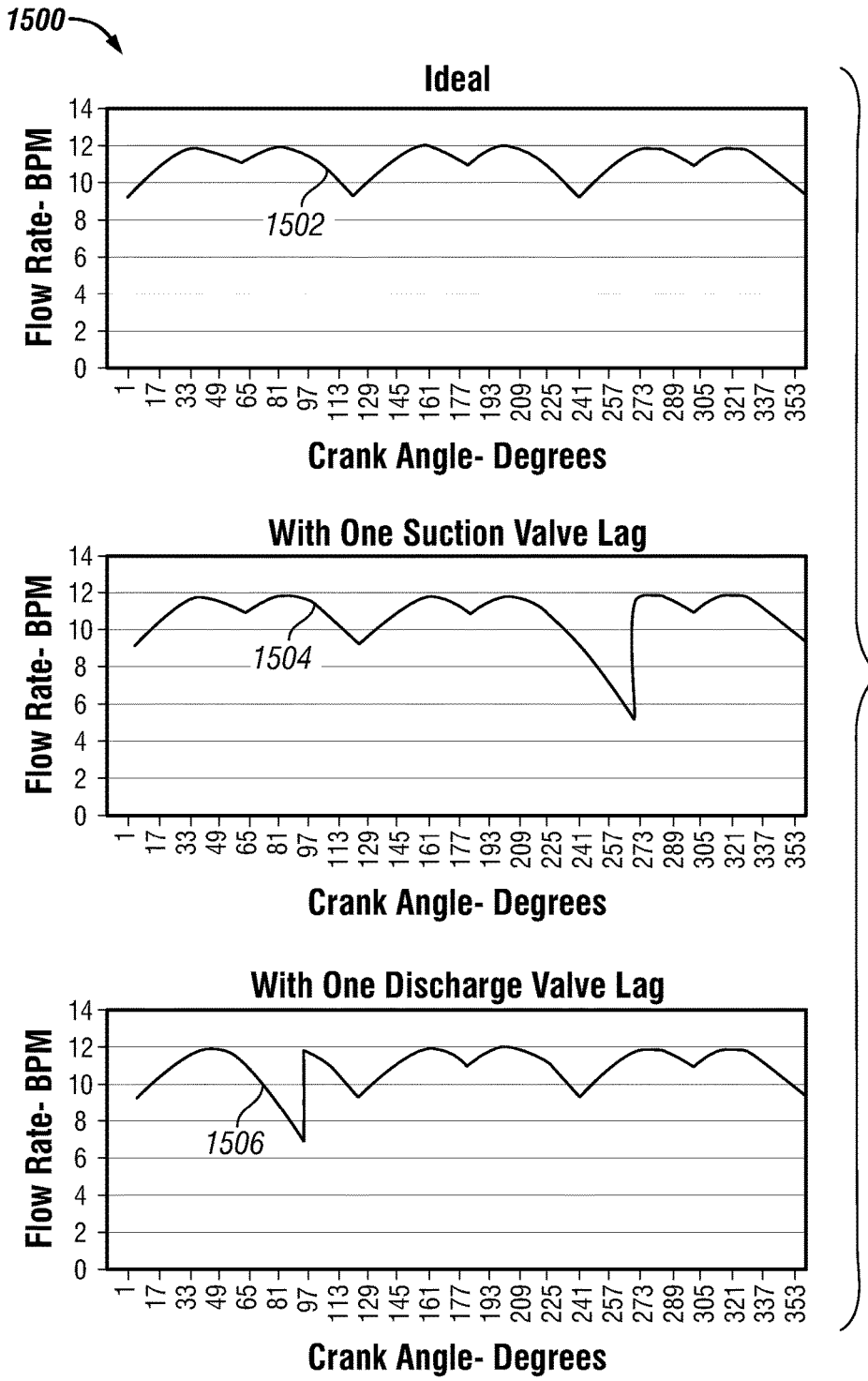
FIG. 15 depicts illustrative data representing flow variation for various pumps as a function of crankshaft position.

Referencing FIG. 15, illustrative data 1500 shows a reference flow waveform depicted at curve 1502 showing a nominal pump operating with none of the suction valves or discharge valves floating. The curve 1504 illustrates an exemplary flow waveform with a single suction valve float implemented. It can be seen that a tube wave will be generated having the frequency of the crankshaft frequency. The curve 1506 illustrated an exemplary flow waveform with a single discharge valve float implemented. By adjusting which valves float, tube waves having a frequency between 1× and 6× (on a triplex pump) the crank shaft frequency can be generated. Embodiments that either operate through fluid viscosity changes, or that are finely tuned to cause float based on the pumping rate of the plunger, can manipulate the number of valves floating by adjusting the fluid viscosity and/or the pumping rate during runtime operations of the pump. Similarly, valve spring force may be manipulated during operations by compressing or extending the valve spring using a suitable mechanism.

Figure 16:
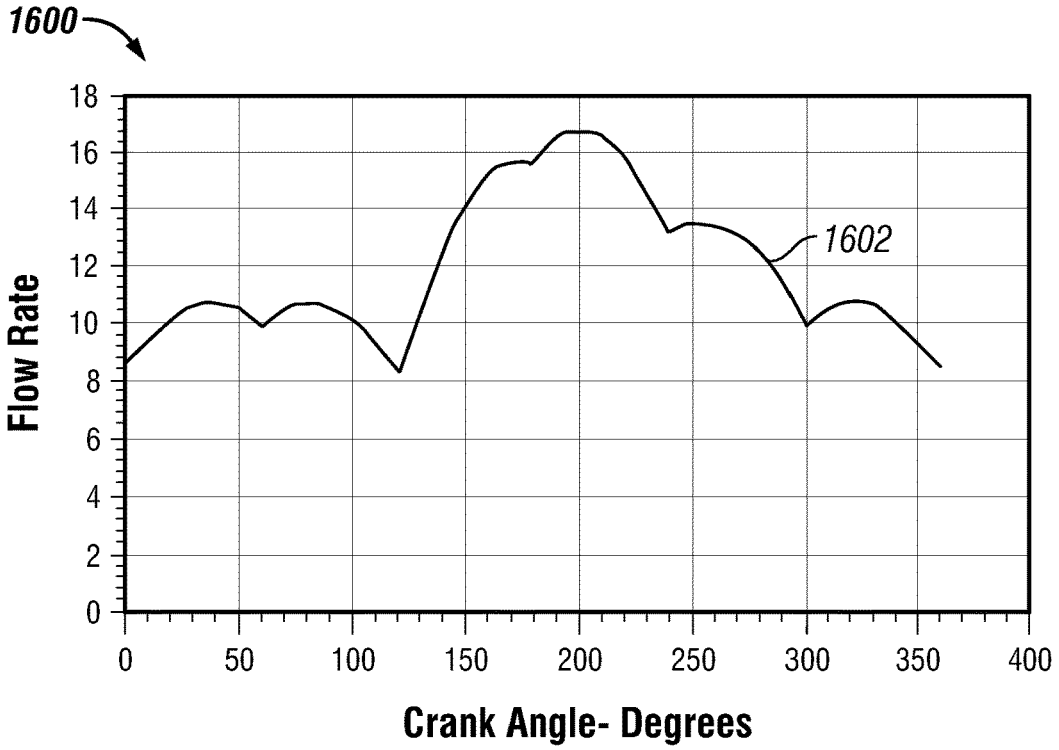
FIG. 16 depicts illustrative data representing flow variation of a pump having one plunger having a distinct head size.

In certain embodiments, a system includes providing at least one head size of a plunger in the pump with a distinct size. For example, a triplex pump may include two 4-inch heads and a single 5-inch head. Referencing FIG. 16, illustrative data 1600 shows a flow waveform 1602 of a triplex pump having a two 4-inch heads and a single 5-inch head. The frequency of the waveform 1602 can be adjusted by adjusting the pumping rate of the pump. In certain embodiments, more than two distinct head sizes may be provided on a pump.

Figure 17:
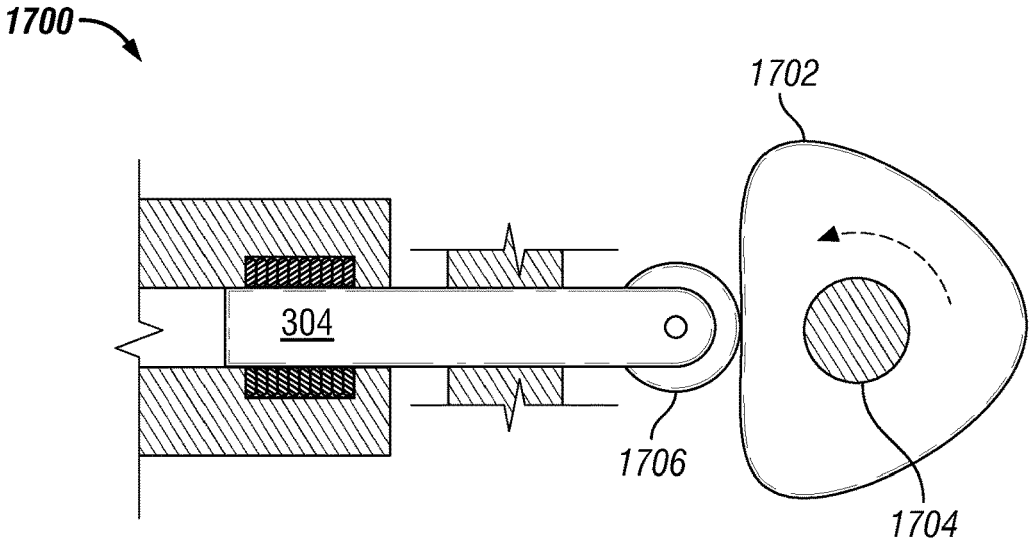
FIG. 17 is an illustration of a cam-driven plunger.
Figure 18:
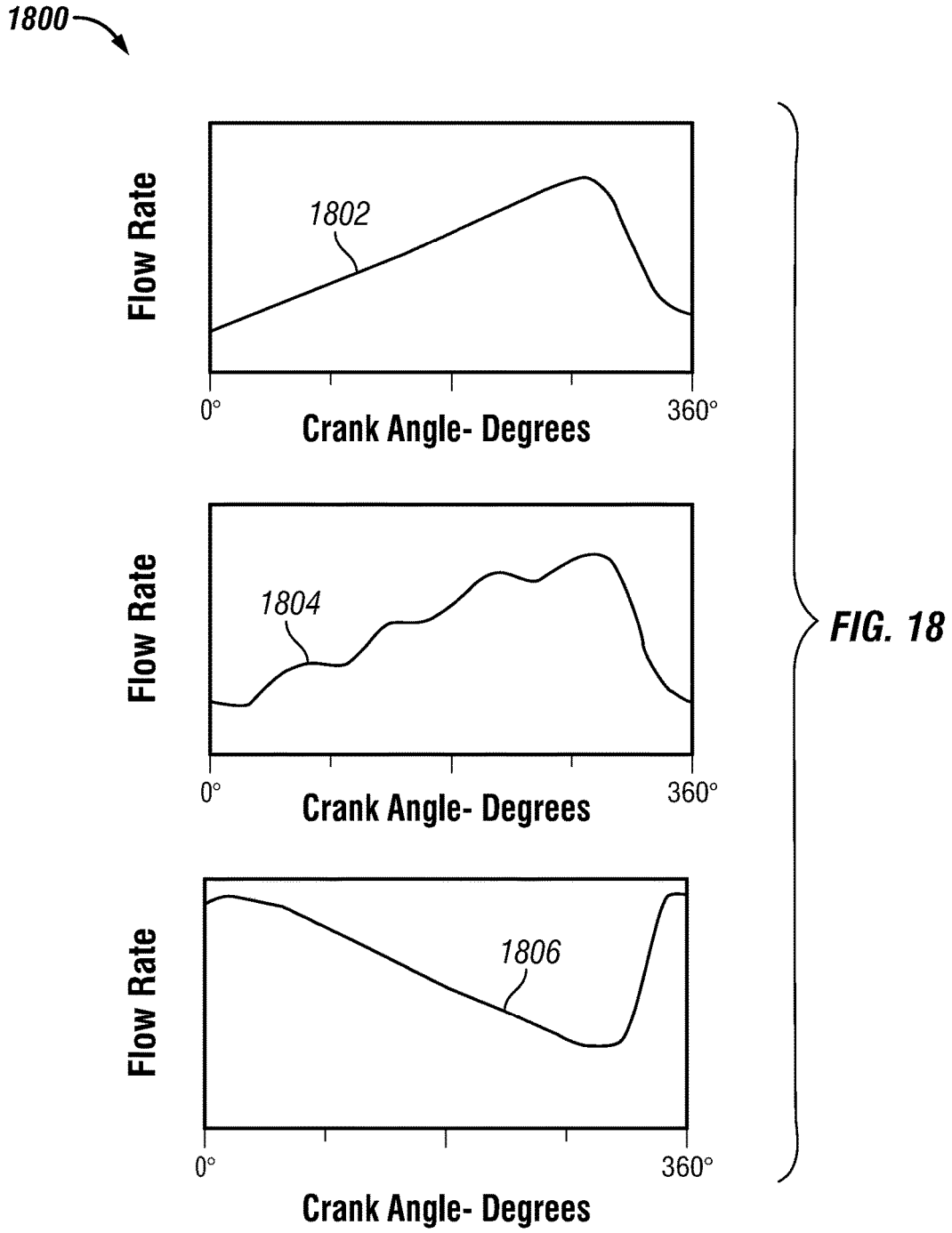
FIG. 18 depicts illustrative data representing a pressure waveform as a function of crankshaft position for various cam-driven plungers.

Referencing FIG. 17, an apparatus 1700 includes a pump having a plunger pump 304 with a cam 1702 mechanically coupling the crankshaft 1704 to the plunger pump 304. The exemplary apparatus 1700 includes a roller 1706 that follows the cam, and a linear guide that confines the plunger pump 304 to linear axial motion in response to the cam 1702. The utilization of a cam 1702 allows the plunger pump 304 to follow a prescribed motion form, and for tailoring the spectrum of the tube wave from the plunger pump 304. Referencing FIG. 18, illustrative data 1800 is shown for several exemplary waveforms that can be produced from a cam 1702 driven plunger pump 304. The first waveform 1802 is an asymmetric waveform providing higher frequency content on the falling side of the waveform. The second waveform 1804 is produced from a four cycles per revolution wave form superimposed on an asymmetric waveform. The third waveform 1806 includes high frequency content in a rising portion of the waveform, illustrating an opposite bias from the first waveform 1802. The described waveforms are illustrative and non-limiting.

Figure 19:
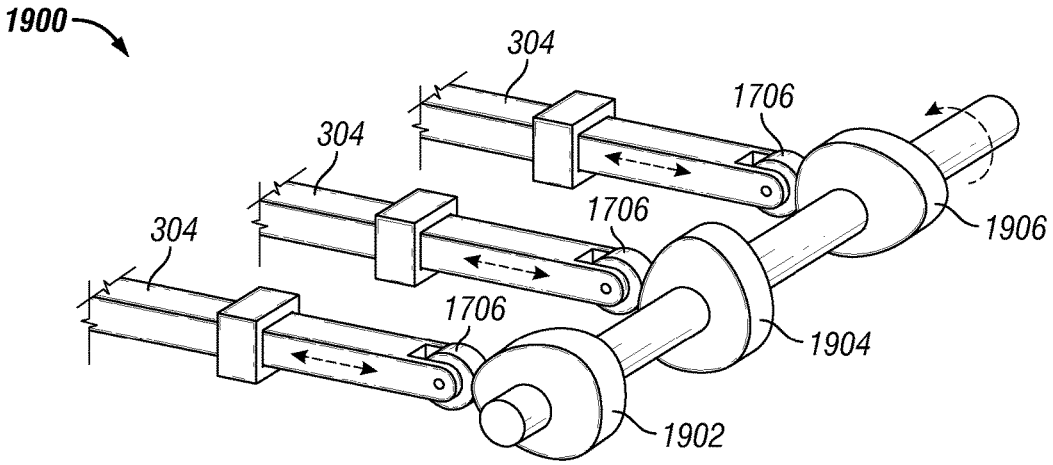
FIG. 19 is an illustration of a pump having a plurality of cam-driven plungers.
Figure 20:
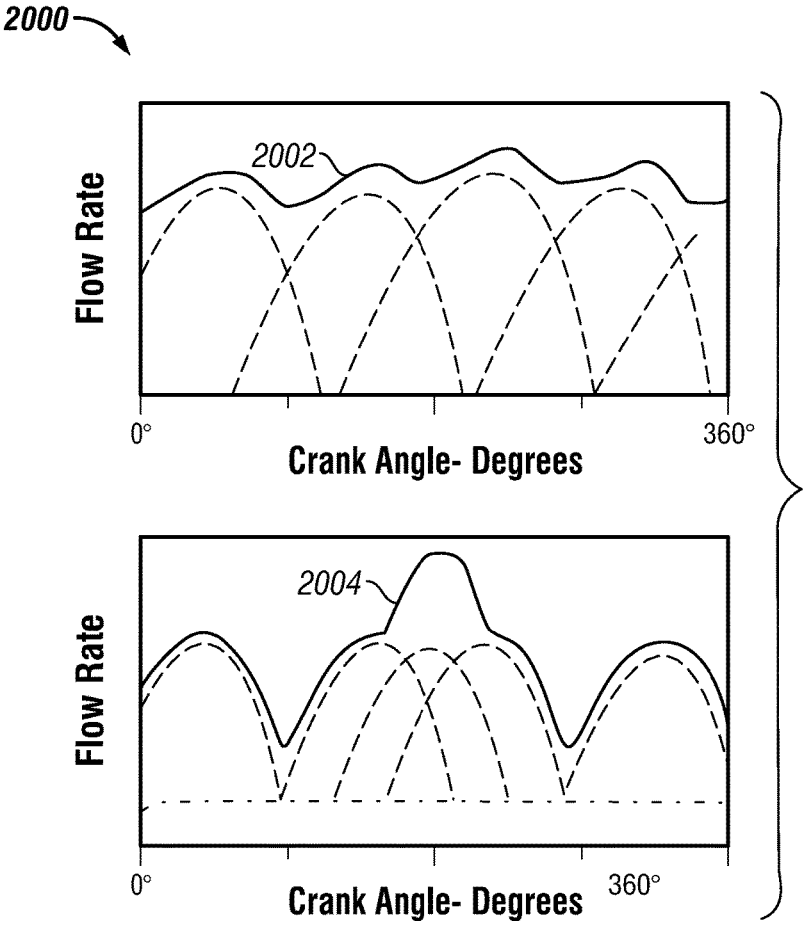
FIG. 20 depicts illustrative data representing a pressure waveform as a function of crankshaft position for a nominal cam-driven pump and for a pump having one cam phase shifted from a nominal position.

Referencing FIG. 19, an apparatus 1900 includes a number of cams 1902, 1904, 1906 each corresponding to one of a number of plungers (only the first plunger pump 304 is depicted). The cams 1902, 1904, 1906 mechanically couple the crankshaft 1704 to the plungers 304, providing a configurable waveform from the operating pump. In certain embodiments, the cams 1902, 1904, 1906 are rotatable relative to each other, allowing for phase shifting of the waveforms provided by each cam 1902, 1904, 1906. Referencing FIG. 20, illustrative data 2000 depicts a first waveform output 2002 generated from the cams 1902, 1904, 1906 operating in phase. A second waveform output 2004 illustrates the waveform generated from the cams 1902, 1904, 1906 operating with one of the cams rotated out of phase with the other two cams. The second waveform output 2004 illustrates a single high peak and two lower troughs generated from the sum of the cam outputs.

Figure 21:
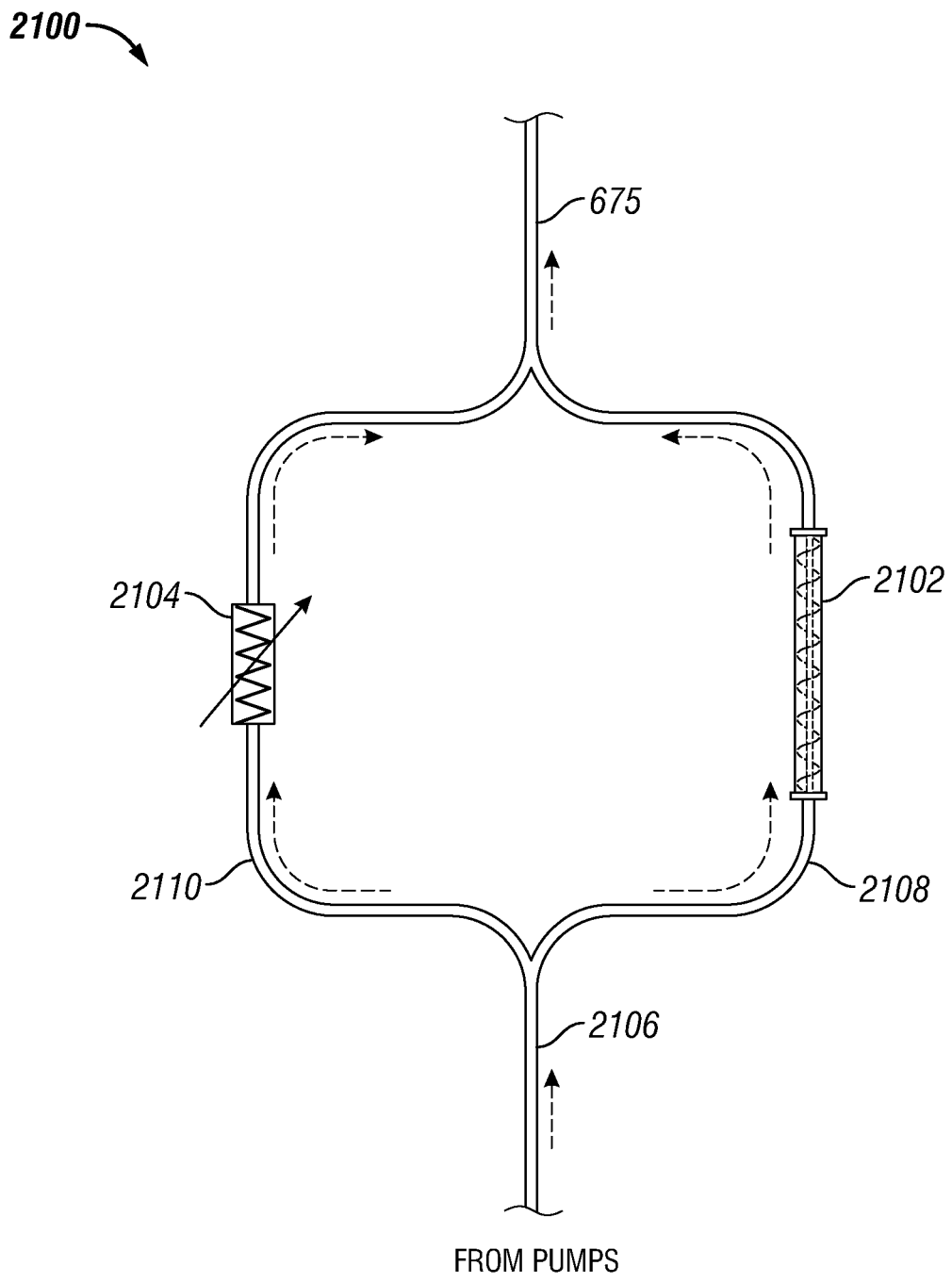
FIG. 21 is a schematic illustration of a progressive chamber pump in parallel flow with a variable pressure drop device.

Referencing FIG. 21, an apparatus 2100 includes a progressive cavity pump 2102 positioned in flow parallel with a variable flow impedance device 2104. The progressive cavity pump 2102 includes any progressive cavity pump understood in the art, including at least a gear pump, a helical screw pump, or similar device. The pump 2102 may be operating as a motor (i.e. passively driven by the fluid flowing in the progressive cavity flowpath 2108) during runtime operations of the apparatus 2100. For example, the pump 2102 may be a mud motor in line with the progressive cavity flowpath 2108. The variable flow impedance device 2104 may be any device known in the art, including a flapper valve or any other device that adjusts the flow impedance of the variable flow impedance path 2110. The inlet flow 2106 to the apparatus 2100 is from one or more pumps, and the treating line 675 or other flow path may be the output path from the apparatus 2100. The inlet flow 2106 may be from all of the pumps on a treating location, or from a subset of the pumps on the treating location. In certain further embodiments, a torque device (not shown) may add or subtract rotational torque to the pump 2102, manipulating the frequency signals generated by the pump 2102. Additionally or alternatively, the variable flow impedance device 2104 may be inline with the pump 2102.

Another exemplary embodiment of includes two pumps operating at the same speed and arranged with a variable phase shift between them. The phase shift is adjusted such that the plungers on one pump go in and out of phase with the plungers of the other pump at the desired signal frequency. This produces a variation in pressure ripple that is at the desired frequency without needing to have either pump operate at this frequency. Exemplary gearboxes (not shown) that can be used in such embodiment include the DLO Series in-line differential phase shifters manufactured by Redex-Andantex and the UE, UEF, LUE, LUEF series of phase shifter gearboxes manufactured by Wilhelm Vogel GmbH Antriebstechnik. Exemplary phase shifter gearboxes allow actuation of a worm drive to manipulate the phase shifting. A controller 106 may be structured to actuate the worm drive (or other phase shift actuation) and thereby controllably generate tube waves having the desired frequency characteristics.

Another exemplary set of embodiments is an apparatus for generating variable frequency tube waves. The apparatus includes a repetitive tube wave generator that includes a positive displacement pump, and a modulator that adjusts a frequency of the repetitive tube wave generator. In an exemplary apparatus, the positive displacement pump is a multiplex pump. An exemplary multiplex pump includes a disabled or removed discharge valve for a plunger of the pump. A further embodiment includes an energy dampening device coupled to the plunger.

Certain exemplary and non-limiting energy dampening (or load balancing) devices are described. An exemplary energy dampening device includes a flywheel operably coupled to the plunger, and may further include a transmission provided between the flywheel and the plunger. Other exemplary energy dampening devices include a pneumatic cylinder(s) operably coupled to the plunger, and/or a spring (s) operably coupled to the plunger. Yet another exemplary energy dampening device includes a fluid pressure connection between a discharge end of the plunger and a chamber exposed to an opposing end of the plunger from the discharge end of the plunger, and may further include an accumulator operably coupled to the chamber. A still further exemplary energy dampening device includes a fluid isolation diaphragm positioned between the accumulator and treatment fluid at the discharge end of the plunger. In certain further embodiments, the apparatus includes a scotch yoke mechanically coupling the plunger to a pump crankshaft, where the energy dampening device is coupled to the scotch yoke.

The operational descriptions which follow provide illustrative embodiments of performing procedures for generating variable frequency tube waves. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

An exemplary procedure includes an operation to generate a repetitive tube wave in a tubular fluidly coupled to a wellbore, and an operation to vary the repetitive tube wave through a number of frequency values. The procedure further includes detecting the reflected tube waves from the wellbore, and determining wellbore information in response to the detected reflected tube waves. An exemplary operation to generate the repetitive tube waves includes providing a multiplex pump having a hole in a suction valve of the pump, and varying the repetitive tube wave through a number of frequency valves by operating the multiplex pump at a number of flow rates.

Another exemplary procedure includes an operation to generate the repetitive tube wave by operating a first pump at a first stroke frequency and operating a second pump at a second stroke frequency, where the repetitive tube wave includes a beat frequency between the first pump and the second pump. In a further embodiment, the procedure includes an operation to modulate the first stroke frequency and/or the second stroke frequency, thereby varying the resulting beat frequency. An exemplary procedure further includes an operation to selectively couple a discharge side of a plunger of a multiplex pump to a suction side of the plunger. The operation to selectively couple the discharge side of the plunger to the suction side of the plunger by controlling a valve positioned in a bypass path from the discharge side to the suction side.

Non-limiting examples of a means for generating variable frequency tube waves including a multiplex high pressure pump are described. Any other embodiments of a means for generating variable frequency tube waves including a multiplex high pressure pump described throughout the present description are also contemplated herein.

An exemplary means for generating variable frequency tube waves including a multiplex high pressure pump includes a multiple plunger pump (i.e. a pump having two or more plungers) having a modified discharge valve. In certain embodiments, one or more of the remaining plungers of the pump may be removed. The modified discharge valve is a discharge valve that is removed or at least partially disabled on one of the plungers.

The means further includes, in certain embodiments, a pressurizing connection between a treatment fluid at the discharge of the pump and an opposing end of the plunger having the discharge valve. The pressurizing connection includes a direct fluid connection, a fluid connection through a valve and/or orifice (either of which may be controllable), and/or an indirect fluid connection where the fluid on the opposing side of the plunger is pressurably coupled to the treatment fluid through a diaphragm. Alternatively or additionally, the means further includes a diaphragm positioned between the plunger and the treatment fluid, such that the plunger is fluidly isolated from the treatment fluid but that pressure pulses from the plunger are transferred to the treatment fluid.

The means further includes, in certain embodiments, an energy storage and/or dissipation device that moderates the load transferred to a prime mover from the exposure of the plunger having the modified discharge valve to the treatment fluid. Exemplary and non-limiting energy storage and/or dissipation devices include one or more springs coupled to the plunger, one or more pneumatic chambers or pistons coupled to the plunger, one or more hydraulic chambers (or accumulators) coupled to the plunger, and/or a flywheel coupled to the plunger. A flywheel coupled to the plunger may further include a transmission between the plunger and the flywheel, such that the flywheel remains in a desired range of operating speeds during the operation of the system. The transmission may include gears and/or be continuously variable. Any of the energy storage and/or dissipation devices may be coupled to a scotch yoke, where the scotch yoke is positioned to mechanically couple a crankshaft from the prime mover to the plunger.

Another exemplary means for generating variable frequency tube waves includes providing a compressible fluid to an inlet of one or more plungers of a positive displacement pump. The compressible fluid may be air, an inert gas, or any other selected fluid. The providing of the compressible fluid to the pump effectively disables the plunger from pressurized pumping operations, at least to the degree that the compressing fluid does not open the discharge valve and the pressure in the plunger chamber does not otherwise exceed the treatment fluid pressure. The providing of the compressible fluid may be performed periodically, intermittently, and/or according to a schedule.

Another exemplary means for generating variable frequency tube waves including a multiplex high pressure pump includes a progressive cavity motor positioned in a parallel flow path between the pump and a wellbore of the system. The parallel flow path includes the progressive cavity motor on one side and a variable flow restriction (e.g. a time-varying resistance member, a controllable valve, etc.) the other side of the parallel flow path. Further exemplary embodiments include a device to apply positive or negative torque to the progressive cavity motor to provide further time variant frequency components generated by the motor.

Another exemplary means for generating variable frequency tube waves including a multiplex high pressure pump includes the pump having one or more suction valves and/or discharge valves with an opening therein. The opening may be drilled and/or constructed in the valve. The opening is sized such that, at high pumping speeds, the pressure on the plunger with the suction valve or discharge valve having the hole is similar to the pressure on the plungers with normal suction valves. In certain embodiments, the size of the hole in the suction valve or discharge valve is empirically determined to keep torque fluctuations on the prime mover during a complete revolution (or set of revolutions defining one complete operating cycle) to be within 50% peak to peak (maximum to minimum). Additionally or alternatively, the size of the hole in the suction valve or discharge valve is empirically determined to prevent torque direction reversals on the crankshaft of the prime mover. Exemplary hole sizes include 0.2 cm to 1.0 cm diameter.

A further embodiment includes sizing the hole in the suction valve or discharge valve such that a discharge valve corresponding to the plunger with the valve having the hole opens before the pumping stroke is complete, but after the discharge valve would open in nominal operations. One of skill in the art can select spring constants for the discharge valve, valve mass values, and/or fluid viscosity values for the selected chamber(s) to induce the desired discharge valve opening timing. The fluid viscosity value for a particular plunger of the pump can be manipulated using an additive to the plunger (e.g. a cross-linker or other thickener) and/or by dividing the suction side of the pump such that the desired plunger suctions a different fluid than the other plungers of the pump.

Another exemplary means for generating variable frequency tube waves including a multiplex high pressure pump includes a hydraulic cylinder coupled to the plunger to provide the linear motion of the plunger. The hydraulic cylinder may be selectively coupled to a front face and/or back face of a plunger feature, or the hydraulic cylinder may be coupled to one of the faces. A hydraulic accumulator may be coupled to either face of the plunger feature. An exemplary embodiment includes the hydraulic cylinder coupled to a front face and the hydraulic accumulator coupled to a back face. The exemplary means additionally or alternatively includes pre-charging the hydraulic system to a treatment pressure, or to an elevated pressure that is lower than the treatment pressure.

Yet another exemplary means for generating variable frequency tube waves including a multiplex high pressure pump includes operating two pumps at the same speed with a variable phase shift between them. An exemplary means includes utilizing a differential phase shifter between the two pumps. Exemplary suitable, non-limiting examples of phase shifter gearboxes include the DLO Series in-line differential phase shifters manufactured by Redex-Andantex, and the UE, UEF, LUE, LUEF series of phase shifter gearboxes manufactured by Wilhelm Vogel GmbH Antriebstechnik. In certain embodiments, manipulation of a worm gear in the differential phase shifter is utilized to modulate the phase difference between the two (or more) pumps to vary the frequency of the tube waves.

Yet another exemplary means for generating variable frequency tube waves including a multiplex high pressure pump includes operating two pumps (or sets of pumps) at speeds that are close to each other, generating a beat frequency between the two pumps. The beat frequency is swept by modulating the speed of one or both pumps (or sets of pumps). The speed of the pump is the speed of the pressure pulses provided by the pump, which is proportional to the crankshaft speed of the pump where a crankshaft is present. Accordingly, two pumps operating at similar speeds may be operating at similar flow rates, or operating at disparate flow rates.

Yet another exemplary means for generating variable frequency tube waves including a multiplex high pressure pump includes operating a first set of one or more pumps at a first rate relationship, operating a second set of one or more pumps at a second rate relationship, and modulating the first and second set of one or more pumps to generate variable frequency tube waves while maintaining an independently defined total pumping rate or pumping schedule. An exemplary embodiment includes the rate relationships being a linear progression, a logarithmic and/or a geometric progression. In certain embodiments, the first and second set of pumps and rate relationships are scheduled such that none of the pumps in the system operates at the same rate. The rate of each pump is the pressure pulse rate, which is proportional to a crankshaft rotational rate for each pump, and which is further proportional to a pumping rate for pumps having identical plunger numbers and sizes. A further exemplary means includes more than two sets of pumps. Each set of pumps may be a single pump or a plurality of pumps, and each set of pumps may have the same number of pumps or a distinct number of pumps.

Yet another exemplary means for generating variable frequency tubewaves includes operating one or more pumps at an acoustically active pump rate, which is a pump rate that provides a pressure pulse at an acoustic frequency of a component operationally coupled to the pump(s). The acoustically active pump rate may be determined analytically or empirically, and may be determined in response to pump rate modulations during operations of a pumping procedure. The system may include more than one component having an acoustic frequency, and/or a component having more than one acoustic frequency, such that more than one acoustically active pump rate is present in the system. The modulating the variable frequency tubewave includes changing a pump rate into and out of an acoustically active pump rate, and/or moving between two or more acoustically active pump rates. The means for generating variable frequency tubewaves may further include positioning one or more pumps close to a wellhead to enhance the acoustic response. The modulating the variable frequency tubewave may be performed at a scheduled rate to provide a controlled signaling sequence.

Yet another means for generating variable frequency tube waves including a multiplex high pressure pump includes modifying at least one suction valve and/or discharge valve on at least one plunger of at least one pump, such that the modified valve exhibits valve float during operations of the pump. The modifications include using a lighter spring on the valve, using a valve having a heavier mass, and/or adding a highly viscous fluid to the plunger suction side of the plunger having the valve to be modified. The highly viscous fluid may be added directly, or may be created in situ by adding a viscosifier to the plunger inlet. A tube wave pulse rate of between 1× and 6× of a crankshaft rotational rate is thereby created, depending upon the number of valves that are modified to float in the pump.

Yet another means for generating variable frequency tube waves including a multiplex high pressure pump includes providing a multiplex pump having non-uniform head sizes. In one example, a triplex pump having two 4-inch heads and one 5-inch head produces tube waves with a frequency that can be varied with the pump rate.

Yet another means for generating variable frequency tube waves including a multiplex high pressure pump includes providing a cam-based interface between the crankshaft and the plungers of a pump, such that the phase difference between the plungers is non-uniform. Accordingly, the cam profile(s) can be adjusted to provide a tailored spectrum for the tube waves. A further embodiment includes a mechanism to allow cams to rotate relative to each other during operations of the pump. An exemplary, non-limiting, mechanism to allow cam rotation includes differential gearing between the cams.

Embodiments disclosed herein are generally related to an apparatus suitable for generating periodic signals in oilfield tubes such as a wellbore that may be swept across a frequency range. In general this apparatus consists of mechanism to change the volume contained in an oilfield tubular and a drive system to move said mechanism according to a variable cycling frequency. The simplest embodiment is a single plunger pump with the discharge valve removed. This device generates a simple sine wave pressure signal with a constant volume delivery whose operating frequency may be altered by changing the speed of the prime mover.

Many variations are also disclosed. For example, cyclic phase variation between two plunger systems and intentional beat frequency generation with two plunger systems can be used to generate a more controllable waveform. A progressing cavity motor (also known as a mud motor) may be employed in line to add a pulsation related to the flow rate to a flowing stream. Modifications to standard triplex pumps may be used to significantly increase the amplitude of the pulses produced and optimize them for this service. Furthermore, cam based pumps may be used to produce distinctive signals and/or controllable characteristics.

The embodiments disclosed herein are suitable for generating repetitive signals where the repetition rate is varied in a controlled manner. In some embodiments, the repetitive signal has frequency components at a frequency such that the wavelength is comparable to the resolution of interest. For instance, in fresh water the speed of sound is about 5000 feet per second. If the interest is to locate an item with a resolution of about 100 feet, the waveform can be designed to have significant frequency components around 50 Hz. Other designs and arrangements may also be employed.

As is evident from the figures and text presented above, a variety of embodiments of the presented concepts are contemplated.

An exemplary set of embodiments is a system for including a multiplex high pressure pump, a tubular fluidly coupling the multiplex high pressure pump to a wellbore, and a means for generating variable frequency tubewaves in the tubular. The system further includes a pressure sensor operably coupled to the tubular, where the pressure sensor detects reflected tubewaves from the wellbore. Certain embodiments of the system include the tubular having a parallel flow path portion, with the parallel flow path portion including a first parallel leg having a progressing cavity motor disposed therein, and a second parallel leg having a variable flow restriction device disposed therein.

Another exemplary system includes a means for generating the variable frequency tubewaves such that the variable frequency tubewaves have an energy characteristic including a pulse amplitude of at least 340 kPa, a pulse amplitude of at least 685 kPa, a pulse amplitude of at least 3,500 kPa, a pulse amplitude of at least 20,000 kPa, a time averaged power of greater than 1 kW, a time averaged power of greater than 7.5 kW, a time averaged power of greater than 75 kW, a time averaged power of at least 445 kW, an time averaged power of greater than 750 kW, and a time averaged power of between 750 kW and 1,500 kW. Yet another exemplary system includes a means for generating the variable frequency tubewaves such that the variable frequency tubewaves have an energy frequency content of at least 1 Hz, at least 10 Hz, and/or at least 50 Hz.

An exemplary system includes a cam-based modification of the multiplex high pressure pump to generate the variable frequency tubewaves. In certain embodiments, the system includes a diaphragm positioned between a treating fluid pressurized by the multiplex high pressure pump and a device generating the variable frequency tubewaves. Another exemplary embodiment includes a number of the multiplex high pressure pumps, where the pumps operate in a rate pattern to generate the variable frequency tubewaves. Exemplary rate patterns include, without limitation, a linear progression of pump rates, a logarithmic progression of pump rates, a random pump rate, and/or a pseudo-random pump rate.

An exemplary embodiment of the system includes the multiplex high pressure pump having at least one plunger with a distinct head size. Yet another exemplary embodiment of the system includes a modification of at least one pump valve (a discharge valve or a suction valve) such that the valve floats during at least one nominal operating condition of the pump.

Another exemplary set of embodiments is a system including a high pressure multiplex pump having a number of plungers, each plunger operatively coupled to a suction valve on a suction side and a discharge valve on a discharge side. The suction valve or the discharge valve of one of the plungers includes an opening therein, such that the plunger on a discharge stroke pushes fluid through the opening in the suction valve or discharge valve. The system includes a tubular fluidly coupling the high pressure multiplex pump to a wellbore, and a pressure sensor that receives tube waves generated by the high pressure multiplex pump and reflected from the wellbore. Certain further embodiments of the exemplary system are described following.

The system further includes the high pressure multiplex pump having three or more plungers, where two of plungers have a suction valve or discharge valve having an opening therein. The opening(s) may be an orifice in the suction valve having any size, or in one embodiment sized between 0.2 cm and 1 cm diameter. An exemplary system includes the opening being sized to provide a pumping pressure for the plunger at a scheduled treatment rate that is not greater than a specified discharge pressure, where the specified discharge pressure is selected as a pressure that does not yet open the discharge valve. Opening the discharge valve, as used herein, includes displacing the discharge valve from a rest position or closed position, such that fluid passes through the normal flow area of the discharge valve. A discharge valve having an opening therein but not yet displaced from the rest or closed position is not opened. Another exemplary system includes the opening being sized such that the discharge valve opens only after the plunger has moved a predetermined distance at a scheduled treatment rate.

Another exemplary system includes a controller configured to perform certain operations for generating a variable frequency tubewave. The controller includes modules structured to functionally execute the operations of the controller, and an exemplary controller includes a tube wave determination module and a pump control module. An exemplary tube wave determination module interprets a tube wave modulation schedule, and the pump control module provides a pump rate command in response to the tube wave modulation schedule. The high pressure multiplex pump is responsive to the pump rate command.

An exemplary apparatus further includes a controller, the controller including an acoustic tuning module that interprets an acoustic frequency of a component operationally coupled to the positive displacement pump, where the acoustic tuning module further determines an acoustically active pump rate. The controller further includes a pump control module that provides a pump rate command to the positive displacement pump in response to the acoustically active pump rate.

Another exemplary set of embodiments is an apparatus for generating variable frequency tube waves. The apparatus includes a repetitive tube wave generator that includes a positive displacement pump, and a modulator that adjusts a frequency of the repetitive tube wave generator. In an exemplary apparatus, the positive displacement pump is a multiplex pump. An exemplary multiplex pump includes a disabled or removed discharge valve for a plunger of the pump. A further embodiment includes an energy dampening device coupled to the plunger.

Certain exemplary and non-limiting energy dampening devices are described. An exemplary energy dampening device includes a flywheel operably coupled to the plunger, and may further include a transmission provided between the flywheel and the plunger. Other exemplary energy dampening devices include a pneumatic cylinder(s) operably coupled to the plunger, and/or a spring(s) operably coupled to the plunger. Yet another exemplary energy dampening device includes a fluid pressure connection between a discharge end of the plunger and a chamber exposed to an opposing end of the plunger from the discharge end of the plunger, and may further include an accumulator operably coupled to the chamber. A still further exemplary energy dampening device includes a fluid isolation diaphragm positioned between the accumulator and treatment fluid at the discharge end of the plunger. In certain further embodiments, the apparatus includes a scotch yoke mechanically coupling the plunger to a pump crankshaft, where the energy dampening device is coupled to the scotch yoke.

In certain embodiments, the exemplary apparatus further includes number of positive displacement pumps, with the pumps divided into a first set of pumps and a second set of pumps. Each set of pumps includes at least one pump. The modulator further includes a controller. The controller includes a tube wave determination module that interprets a first rate relationship for the first set of pumps and a second rate relationship for the second set of pumps. The controller further includes a pumping requirements module that interprets a total pumping rate and/or a pump schedule, and a pump control module that provides pump rate commands to the first set of pumps and the second set of pumps in response to the first rate relationship, the second rate relationship, and the one of the pumping rate and the pump schedule.

In certain embodiments, the pumping requirements module determines a first pumping contribution from the first set of pumps and a second pumping contribution from the second set of pumps, such that a total amount of fluid delivered from the pumps matches the pumping rate or the relevant portion of the pump schedule. In certain further embodiments, the controller includes a tube wave feedback module that determines pumping rates actually achieved from each pump, and identifies aspects of reflected tube waves in response to the pumping rates actually achieved. In certain embodiments, the first rate relationship and the second rate relationship are enforced, and/or the pumps are controlled to rates matching the first rate relationship and the second rate relationship over a period of time.

Yet another exemplary set of embodiments is a method including generating a repetitive tube wave in a tubular fluidly coupled to a wellbore, varying the repetitive tube wave through a number of frequency values, detecting the reflected tube waves from the wellbore, and determining wellbore information in response to the detected reflected tube waves. An exemplary operation to generate the repetitive tube waves includes providing a multiplex pump having a hole in a suction valve of the pump, and the operation to vary the repetitive tube wave through a number of frequency valves includes operating the multiplex pump at a number of flow rates.

An exemplary method further includes generating the repetitive tube wave by operating a first pump at a first stroke frequency and operating a second pump at a second stroke frequency, where the repetitive tube wave includes a beat frequency between the first pump and the second pump. In a further embodiment, the method includes modulating the first stroke frequency and/or the second stroke frequency. An exemplary method further includes selectively coupling a discharge side of a plunger of a multiplex pump to a suction side of the plunger.

Another exemplary set of embodiments is a system for generating variable frequency tube waves including a multiplex high pressure pump, a tubular fluidly coupling the multiplex high pressure pump to a wellbore, and a means for generating variable frequency tubewaves in the tubular. The system further includes a pressure sensor operably coupled to the tubular, where the pressure sensor detects reflected tubewaves from the wellbore. Certain embodiments of the system include the tubular having a parallel flow path portion, with the parallel flow path portion including a first parallel leg having a progressing cavity motor disposed therein, and a second parallel leg having a variable flow restriction device disposed therein.

Another exemplary system includes a means for generating the variable frequency tubewaves such that the variable frequency tubewaves have an energy characteristic including a pulse amplitude of at least 340 kPa, a pulse amplitude of at least 685 kPa, a pulse amplitude of at least 3,500 kPa, and/or a pulse amplitude of at least 20,000 kPa. The pulse amplitude is the peak-to-peak pressure difference between pulses. Yet another exemplary system includes a means for generating the variable frequency tubewaves such that the variable frequency tubewaves have an energy characteristic including a time averaged power of greater than 1 kW, a time averaged power of greater than 7.5 kW, a time averaged power of greater than 75 kW, a time averaged power of at least 445 kW, an time averaged power of greater than 750 kW, and/or a time averaged power of between 750 kW and 1,500 kW.

The time averaged power is the energy input delivered as pressure pulse signaling that averaged over the signaling period of time. An exemplary and non-limiting example of a means for delivering variable frequency tubewaves having a peak to peak pulse amplitude of at least 20,000 kPa includes a multiplex hydraulic fracturing pump having a suction valve with a hole formed therein. A multiplex hydraulic fracturing pump having a suction valve with a hole formed therein is capable of delivering pulses having energy values of more than 375 kW, and pulses having energy values up to 1,500 kW.

Yet another exemplary system includes a means for generating variable frequency tubewaves having an energy frequency content of at least 1 Hz, at least 10 Hz, and/or at least 50 Hz. The energy frequency content is a frequency characteristic of the delivered pulses—for example the frequency component of the fundamental frequency or a resolvable harmonic—resulting from the frequency tubewave generating device.

An exemplary system includes a cam-based modification of the multiplex high pressure pump to generate the variable frequency tubewaves. In certain embodiments, the system includes a diaphragm positioned between a treating fluid pressurized by the multiplex high pressure pump and a device generating the variable frequency tubewaves. Another exemplary embodiment includes a number of the multiplex high pressure pumps, where the pumps operate in a rate pattern to generate the variable frequency tubewaves. Exemplary rate patterns include, without limitation, a linear progression of pump rates, a logarithmic progression of pump rates, a random pump rate, and/or a pseudo-random pump rate.

Another exemplary embodiment of the system includes the multiplex high pressure pump having at least one plunger with a distinct head size. Yet another exemplary embodiment of the system includes a modification of at least one pump valve (a discharge valve or a suction valve) such that the valve floats during at least one nominal operating condition of the pump.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Furthermore, none of the descriptions in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of the presented claims are intended to invoke paragraph six of 35 USC § 112 unless the exact words "means for" appear, followed by a participle. The claims as filed are intended to be as comprehensive as possible, and NO subject matter is intentionally relinquished, dedicated, or abandoned.

What is claimed is:

1. A system, comprising:

a high pressure multiplex pump comprising a plurality of plunger pumps, each plunger pump operatively coupled to a suction valve on a suction side and a discharge valve on a discharge side, wherein at least one of the suction valve or the discharge valve operatively coupled to each plunger pump comprises an orifice check valve;

wherein a first discharged valve of a first plunger pump of the plurality of plunger pumps comprises a discharge valve orifice, such that the first plunger pump pushes fluid through the discharge valve orifice into the discharge side without opening the discharge valve;

an energy dampening device coupled to one of the plurality of plunger pumps through a hydraulic cylinder to at least partially balance one or more static forces on the one of the plurality of plunger pumps;

a tubular fluidly coupling the high pressure multiplex pump to a wellbore penetrating a formation of interest via the discharge side, wherein the high pressure multiplex pump is configured to generate and send variable frequency tube waves to the tubular via the fluid pushed through the discharge valve orifice;

a pressure sensor configured to receive the variable frequency tube waves generated by the high pressure multiplex pump and reflected from the wellbore; and a controller connected to the pressure sensor and the high pressure multiplex pump, wherein the controller is configured to control one or more operations of the high pressure multiplex pump, wherein the one or more operations comprises generating the variable frequency tube waves.

2. The system of claim 1, wherein the suction valve of the first plunger pump comprises a suction valve orifice, such that the first plunger pump on a first portion of a discharge stroke pushes the fluid through the suction valve orifice, wherein the suction valve orifice is configured to remain open when the suction valve is closed.

3. The system of claim 1, wherein the discharge valve orifice comprises a diameter between 0.2 cm and 1 cm.

4. The system of claim 1, wherein the discharge valve opens only after the first plunger pump has moved a predetermined distance at a scheduled treatment rate.

5. The system of claim 1, wherein the controller further comprises:

a tube wave determination module structured to interpret a tube wave modulation schedule:

a pump control module structured to provide a pump rate command in response to the tube wave modulation schedule; and wherein the high pressure multiplex pump is responsive to the pump rate command.

6. The system of claim 1, wherein the energy dampening device comprises a pneumatic cylinder.

7. The system of the claim 1, wherein the energy dampening device comprises a spring.

* * * * *